US006367289B2

(12) United States Patent
Ganor et al.

(10) Patent No.: US 6,367,289 B2
(45) Date of Patent: Apr. 9, 2002

(54) ACTUATOR SYSTEM FOR KNITTING MACHINES

(75) Inventors: Ze'ev Ganor, Herzelia; Izhak Rafaeli; Nir Karasikov, both of Haifa, all of (IL)

(73) Assignee: Nanomotion Ltd., Yokneam (IL)

( * ) Notice: Subject to any disclaimer, the term of this patent is extended or adjusted under 35 U.S.C. 154(b) by 0 days.

(21) Appl. No.: 09/773,822

(22) Filed: Feb. 1, 2001

Related U.S. Application Data

(60) Division of application No. 09/423,939, filed as application No. PCT/IL98/00111 on Mar. 8, 1998, now Pat. No. 6,244,076, which is a continuation-in-part of application No. PCT/IL97/00160, filed on May 15, 1997.

(51) Int. Cl.[7] ..... D04B 7/00
(52) U.S. Cl. ..... 66/62; 66/13
(58) Field of Search ..... 66/7, 8, 13, 16, 66/17, 218, 219, 222, 62, 64, 75.2, 116, 121; 310/311, 314, 317, 319, 331, 367, 368

(56) References Cited

U.S. PATENT DOCUMENTS

| | | | | | |
|---|---|---|---|---|---|
| 3,788,105 | A | * | 1/1974 | Brose | 66/62 |
| 4,562,374 | A | * | 12/1985 | Sashida | 66/62 |
| 4,770,009 | A | * | 9/1988 | Mozer | 66/62 |
| 5,042,274 | A | * | 8/1991 | Maruyama et al. | 66/62 |
| 5,291,756 | A | * | 3/1994 | Venturini | 66/62 |
| 5,588,312 | A | * | 12/1996 | Hashimoto | 66/62 |
| 5,823,015 | A | * | 10/1998 | Shibata | 66/62 |
| 6,220,062 | B1 | * | 4/2001 | Enomoto et al. | 66/62 |
| 6,244,076 | B1 | * | 6/2001 | Ganor et al. | 66/62 |
| 6,247,338 | B1 | * | 6/2001 | Ganor et al. | 66/62 |

FOREIGN PATENT DOCUMENTS

| | | | | |
|---|---|---|---|---|
| DE | 44 11 528 A1 | | 10/1995 | |
| DE | 4411528 | * | 10/1995 | 66/62 |
| DE | 195 38 937 A1 | | 4/1997 | |
| DE | 19538937 | * | 4/1997 | 66/62 |
| EP | 0 456 126 A1 | | 11/1991 | |
| EP | 456126 | * | 11/1991 | 66/62 |
| EP | 578166 | * | 1/1994 | 66/62 |
| EP | 0 578 166 A1 | | 1/1994 | |
| EP | 717136 | * | 6/1996 | 66/62 |
| EP | 0 717 136 A1 | | 6/1996 | |
| FR | 2136749 | | 12/1972 | |
| WO | WO 97/08374 A | | 3/1997 | |
| WO | 9708374 | * | 3/1997 | 66/62 |

* cited by examiner

*Primary Examiner*—Danny Worrell

(57) ABSTRACT

An actuator system for activating a latch needle, which latch needle has a shaft, comprising: a flat planar extension of said shaft having first and second parallel planar surfaces; at least one piezoelectric micromotor having a first surface region for transmitting motion to a moveable element, which first surface region is resiliently pressed to said first surface and at least one additional piezoelectric motor having a second surface region for transmitting motion to a moveable element which second surface region is resiliently pressed to said second surface; and wherein vibratory motions of said first and second surface regions apply forces to said flat extension that cause motion in said latch needle.

8 Claims, 15 Drawing Sheets

ACTUATOR SYSTEM FOR KNITTING MACHINES

RELATED APPLICATIONS

The present application is a divisional of U.S. application Ser. No. 09/423,939, now U.S. Pat. No. 6,244,076, which was filed in the U.S. Patent and Trademark Office on Mar. 27, 2000 as a national application of PCT/IL98/00111, filed Mar. 8, 1998, which is a continuation-in-part of PCT/IL/97/00160 filed on May 15, 1997.

FIELD OF THE INVENTION

The present invention relates to knitting machines and in particular to means and methods for activating latch needles in knitting machines and monitoring latch needle positions.

BACKGROUND OF THE INVENTION

Automatic knitting machines use banks of large numbers of closely spaced latch needles to interlock threads in a series of connected loops to produce a knitted fabric. The latch needle is a long flat needle having, at one end, a small hook and a latch that swivels to open and close the hook. The hook ends of the latch needles are moved forwards and backwards towards and away from the threads being knitted into the fabric. As a latch needle is moved, its latch alternately opens and closes so that the hook catches a thread close to it, pulls it to create a loop of fabric, and then releases the thread to start the cycle over again and produce another loop of fabric.

Latch needles are arranged parallel to each other, in arrays of many hundreds to thousands of latch needles in modem knitting machines. The latch needles are placed into narrow latch needle slots that are machined into a planar surface, hereafter referred to as a "needle bed surface", of a large rectangular metal plate, hereafter referred to as a "needle bed". The latch needle slots hold the latch needles in position and confine their motion to linear displacements along the lengths of the latch needle slots. The latch needle slots are parallel to each other and equally spaced one from the other with spacing that varies depending upon the quality and type of fabric being produced. Spacing of two to three millimeters is typical, but spacing significantly less than and greater than two millimeters are also common.

The latch needle slots in a needle bed are sufficiently deep so that all or most of the body of a latch needle lies completely in the latch needle slot in which it is placed and below the needle bed surface into which the latch needle slots are machined. A small square fin that sticks out from one side of the shaft of the latch needle protrudes above the needle bed surface. The fins of all latch needles in a needle bed are accurately aligned in a single straight row perpendicular to the latch needle slots.

The latch needles are moved, hereafter referred to as "activated", back and forth in their respective latch needle slots in order to form loops in a fabric being knitted, by a shuttle that travels back and forth along the length of the needle bed surface parallel to the row of aligned latch needle fins. The shuttle has a flat planar surface facing and parallel to the needle bed surface that extends the full length of the shuttle along the direction of travel of the shuttle. The surface has a channel extending the full length of the shuttle along the direction of travel of the shuttle. The channel is open at both of its two ends, and both ends are aligned with the row of aligned fins. As the shuttle moves along the row of latch needle fins, the fins of the latch needles sequentially enter the channel at one end of the channel, travel along the channel length and exit the channel at the other end of the channel. For most of its length the channel is parallel to the row of aligned fins, i.e. the direction of travel of the shuttle, however towards its middle it has a bend. A latch needle is activated when its fin encounters the bend and moves along the direction of the bend. In moving along the direction of the bend, the fin and its latch needle are moved back and forth along the direction of the latch needle slot in which the latch needle is placed, i.e. perpendicular to the row of aligned fins.

The conventional method for moving latch needles in a knitting machine as described above has a number of drawbacks.

For one, the sequential activation of latch needles by a shuttle as the shuttle moves along a needle bed limits the production rates of fabrics. Production rates of fabric produced by knitting machines could be increased if latch needles were individually activated and different combinations of latch needles could be moved simultaneously. Some shuttles in fact have more than one channel in order to simultaneously activate more than one latch needle and increase production rate.

In addition, in the process of knitting a fabric, dust and dirt accumulate in the slots in which latch needles of a knitting machine move. As the dust and dirt accumulate, more force is required to move the latch needles. At some point, dust and dirt accumulate to such an extent that a latch needle jams in its slot. The shuttle is too massive and moves too quickly for it to be practical for the shuttle to be sensitive to, or respond to, changes in the force needed to move a particular latch needle. As the shuttle rushes along the needle bed and encounters a jammed latch needle it breaks the fin or some other part of the jammed latch needle. When this happens physical damage to the knitting machine is often considerably more extensive than the damage to the single latch needle that jammed and knitting machine down time as a result of the damage is prolonged.

In order to prevent damage to knitting machines from jammed latch needles it would be advantageous to have a system for moving latch needles in a knitting machine that activates latch needles individually and is responsive to changes in the forces required to move individual latch needles.

Prior art direct needle drive systems exist that provide for individual activation of latch needles in a knitting machine. These systems, hereafter referred to as "DND" systems, generally provide an actuator for each latch needle and a system for monitoring the position of each latch needle. However, the prior art systems have not been completely satisfactory. The dimensions of actuators used in the prior art systems are large compared to the spacing between latch needles. Complicated spatial configurations are therefore required to pack large numbers of the actuators in a convenient volume of space near to the latch needles in order to couple the actuators to the latch needles.

Additionally, the response times of prior art DND systems are slow. This is the result of slow response times of actuators and of latch needle position monitoring systems used in these systems. The advantages in production rate and decreased knitting machine down time that should be provided by prior art DND systems are at least partly neutralized by the slow response times of these systems.

SUMMARY OF THE INVENTION

It is an object of one aspect of the present invention to provide a knitting machine comprising a fast response time DND system for activating latch needles in the knitting machine.

It is an object of another aspect of the present invention to provide a DND system in which each latch needle of a knitting machine is activated exclusively by at least one piezoelectric micromotor which activates only that latch needle.

An object of another aspect of the present invention is to provide a piezoelectric micromotor suitable for use in a fast response time DND system.

An additional aspect of the present invention is to provide a transmission for coupling each latch needle in a DND system, in accordance with a preferred embodiment of the present invention, to an at least one piezoelectric micromotor, which at least one piezoelectric micromotor, hereafter referred to as "at least one exclusive piezoelectric micromotor", is not coupled to any other latch needle.

Piezoelectric micromotors can be made small and powerful and response times of piezoelectric micromotors can satisfy the fast response time requirements of modem knitting machines. The dynamic range of motion available from piezoelectric micromotors and the energy that can be transmitted in short periods of time from piezoelectric micromotors to moveable elements are also consistent with the requirements of modem knitting machines. A piezoelectric micromotor and transmission, in accordance with preferred embodiments of the present invention, can therefore be used to provide fast response time activation of individual latch needles in a kitting machine.

It is an object of yet another aspect of the present invention to provide a DND system comprising a fast response time system for monitoring the position of latch needles activated by the DND system.

It is a further object of another aspect of the present invention to provide an electro-optical latch needle position monitoring system, hereafter referred to as an "OPM", that operates with a fast response time.

DND systems by their nature require fast response time position monitoring systems for monitoring the positions of latch needles that they activate. The positions of the latch needles are controlled in knitting machines to accuracy on the order of 25–50 micrometers ($\mu$m). A DND system that moves latch needles with a velocity "V" must therefore sample the position of each latch needle it activates with a frequency of between ~2x(Vm/sec÷25 $\mu$m) to 2x(Vm/sec÷50 $\mu$m), in order to control the position the latch needle to an accuracy of 25 $\mu$m–50 $\mu$m. It therefore requires a position monitoring system with a response time on the order of (25 $\mu$m–50 $\mu$m)/2V. In many conventional knitting machines V is on the order of 1.5 m/sec. A DND system that moves latch needles with this velocity therefore requires a system that samples the position of latch needles with a frequency, or sampling rate, of between 50–100 kHz and a response time between 10 $\mu$sec and 20 $\mu$sec.

Electro-optical systems inherently operate at frequencies that are much faster than typical mechanical cycle frequencies of motion of knitting machine components. In particular an electro-optical OPM, in accordance with a preferred embodiment of the present invention, can provide the fast response time and accuracy of measurement required for monitoring latch needle positions in DND systems.

A piezoelectric micromotor for operating individual latch needles in a DND, in accordance with a preferred embodiment of the present invention, comprises a ceramic vibrator formed in the shape of a thin flat plate having two large planar surfaces and narrow edge surfaces. Piezoelectric vibrators of this type are described in U.S. Pat. No. 5,453,653, which is incorporated herein by reference. The thickness of the vibrator preferably ranges from one to a few millimeters. The thickness of the vibrator thus has dimensions on the order of the size of the spacing between latch needles in a needle bed. It is therefore possible to pack large numbers of these vibrators close to each other with their large planar surfaces parallel and with a thin edge of each vibrator aligned with a single latch needle in the needle bed. Each latch needle is activated (i.e. moved back and forth in its latch needle slot in order to form a loop in a fabric being knitted) by coupling to the latch needle vibratory motion of at least one exclusive piezoelectric micromotor having a thin edge aligned with the latch needle. Coupling of the latch needle and the vibratory motion of the at least one exclusive piezoelectric motor may be accomplished by means of a transmission, in accordance with a preferred embodiment of the present invention.

In a DND, in accordance with a preferred embodiment of the present invention, latch needles in a knitting machine needle bed and piezoelectric micromotors are coupled by a rotary transmission comprising a bearing shaft on which a plurality of annuli is stacked. The annuli rotate freely on the bearing shaft. Each latch needle in the knitting machine needle bed is coupled to vibratory motion of a different at least one exclusive piezoelectric motor via one of the plurality of annuli.

The bearing shaft is mounted over the needle bed, preferably close to the needle bed and with its axis parallel to the needle bed and perpendicular to the latch needle slots in the needle bed. The spacing between the annuli on the shaft is such that the fin of each latch needle in the needle bed is aligned with a different annulus on the bearing shaft. A preferably rigid connecting arm connects the fin of each latch needle in the needle bed to the annulus with which the latch needle fin is aligned. The connecting arm is attached to the fin, preferably by a slideable or flexible joint, formed using methods known in the art.

Each annulus on the bearing shaft is coupled to its own at least one exclusive piezoelectric micromotor, in accordance with a preferred embodiment of the present invention by resiliently pressing the at least one exclusive piezoelectric micromotor against the annulus. Activation of the piezoelectric micromotors coupled to an annulus causes the annulus to rotate. The rotation of the annulus is transmitted to the fin of the latch needle to which the annulus is connected, by the connecting arm. The joint connecting the fin and the connecting arm translates the rotational motion of the connecting arm to a linear motion of the latch needle forwards and backwards in its latch needle slot parallel to the length of the latch needle slot, thereby activating the needle.

In a DND system, in accordance with an alternative preferred embodiment of the present invention latch needles in a knitting machine needle bed and piezoelectric micromotors are coupled by a linear transmission. With the linear transmission each latch needle in a knitting machine needle bed has at least one exclusive piezoelectric micromotor pressed, preferably by resilient force, directly onto the shaft of the latch needle or onto a suitable extension of the shaft of the latch needle. The latch needle slots in which the latch needles are placed, and/or, the surfaces of the needles in contact with the latch needle slots are preferably provided with bearings or nonstick surfaces. This reduces the possibility of a latch needle jamming or sticking in its latch needle slot under the application of the resilient force pressing the at least one exclusive piezoelectric micromotor to the latch needle shaft or suitable extension thereof. Coupled in this way, vibratory motion of the at least one exclusive micromotor pressed to a latch needle shaft or extension thereof activates the latch needle by causing the latch needle to move back and forth in its latch needle slot.

In another form of linear transmission, in accordance with a preferred embodiment of the present invention, piezoelectric micromotors are coupled directly to a "coupling" fin of a latch needle in order to transmit motion to the latch needle. The coupling fin, except for its dimensions, is preferably similar in shape and construction to conventional latch needle fins. The coupling fin is a planar extension of the body of the latch needle having first and second parallel planar sides and thin edges. Preferably, the coupling fin is formed as an integral part of the latch needle and lies in the plane of the body of the latch needle (the latch needle is flat). A rectangular region of the first side and a rectangular region of the second side, hereafter referred to as first and second "coupling regions" respectively, are preferably clad in wear resistant material suitable for friction coupling with piezoelectric micromotors, such as for example, alumina. Preferably, the first and second coupling regions are congruent and directly opposite each other.

In one configuration for coupling piezoelectric micromotors to the coupling fin, in accordance with a preferred embodiment of the present invention, at least one micromotor is resiliently pressed to each of the first and second coupling regions so that a surface region of the micromotor used for transmitting motion from the micromotor to a moveable element, or a hard wear resistant friction nub on the surface region, contacts the coupling region. Preferably, the same number of piezoelectric micromotors is resiliently pressed to each of the first and second coupling regions. Preferably the at least one micromotor pressed to the first coupling region is identical to the at least one micromotor pressed to the second coupling region. Preferably, points at which the at least one micromotor pressed to the first coupling region contacts the first coupling region and points at which the at least one micromotor pressed to the second coupling region contacts the second coupling region are directly opposite each other. Preferably, the magnitude of the forces exerted on the coupling fin perpendicular to the plane of the coupling fin by the at least one micromotor pressed to the first and second coupling regions are equal. Preferably, the at least one piezoelectric micromotor pressed to each coupling region comprises one micromotor.

The latch needle is driven back and forth in its latch needle slot when the at least one piezoelectric micromotor pressed to the first and second coupling regions are activated so as to transmit linear motion in the same direction to the coupling fin. Preferably, the at least one piezoelectric micromotor pressed to the first and second coupling regions are activated in phase. This substantially prevents a torque that tends to twist the latch needle in its latch needle slot from developing.

In another configuration for coupling piezoelectric micromotors to the coupling fin, accordance with a preferred embodiment of the present invention, a piezoelectric micromotor coupled to a coupling fin is mounted in a transmission bracket. The transmission bracket comprises a bearing or a non-stick surface area against which a surface region of the micromotor used for transmitting motion to a moveable element, or preferably, a wear resistant friction nub on the surface region of the micromotor, is resiliently pressed. In order to couple the piezoelectric micromotor to the coupling fin, the coupling fin is inserted between the friction nub and the bearing or the non-stick surface. With this coupling configuration a single piezoelectric micromotor can be used to activate a latch needle without causing unwanted torque that twists the latch needle in its latch needle slot. Force exerted by the piezoelectric micromotor perpendicular to the plane of the coupling fin is opposed by an equal and opposite force exerted on the coupling fin by the bearing or the non-stick surface.

In order to couple adjacent latch needles in a needle bed to piezoelectric micromotors using coupling fins, in accordance with a preferred embodiment of the present invention, coupling fins of adjacent latch needles are preferably displaced with respect to each other in the direction of motion of the latch needles and/or protrude different distances above the latch needle bed. This provides sufficient space between piezoelectric micromotors coupled to coupling fins of adjacent latch needles so that the piezoelectric micromotors do not interfere with the motion of the latch needles.

A DND system controls latch needle actuators responsive to the position of the particular latch needle to which the actuators are coupled. In a DND system, in accordance with a preferred embodiment of the present invention, latch needle positions are monitored by an OPM.

An OPM, in accordance with a preferred embodiment of the present invention, monitors the position of a latch needle by optically tracking the position of a small light reflecting region, or a region comprising areas of substantially different reflectivity, such as a light reflecting region with a black line, hereafter referred to as a "fiducial", located at a known fixed position on the latch needle. The fiducial is illuminated by light from an appropriately located light source, hereafter referred to as a "fiducial illuminator". The fiducial reflects a portion of the light from the fiducial illuminator with which it is illuminated into an optical device, hereafter referred to as a "fiducial imager", comprising a detector having a light sensitive surface. The fiducial imager uses the reflected light to form an image of the fiducial on the light sensitive surface of its detector. A change in the position of the fiducial causes a change in the image of the fiducial on the light sensitive surface, which change is used to determine the change in position of the fiducial.

There are a number of other ways in which the latch needle can be provided with a fiducial, in accordance with preferred embodiments of the present invention. For example, a small retro-reflector can be fixed to a point on the body of the latch needle or an appropriate reflecting discontinuity, such as a scratch or dimple, can be formed on a region of the surface of the latch needle. Preferably, the fiducial reflects incident light diffusely within a cone of half energy angle on the order of 10°–20°. The detector and fiducial illuminator comprised in a fiducial imager, in accordance with a preferred embodiment of the present invention, are located so that at any position occupied by the latch needle in its operating range of motion, substantially all the light reflected by the latch needle fiducial into the half energy cone is incident on the detector.

In order to provide position measurements for a plurality of latch needles in a needle bed of a knitting machine, an OPM, in accordance with a preferred embodiment of the present invention, comprises a plurality of fiducial imagers arranged in an array. Preferably, the fiducial imagers are aligned collinearly in a line array defined by an axis that is a straight line. Preferably, the axis is parallel to the needle bed surface of the needle bed and perpendicular to the directions of the needle bed slots.

The number of the plurality of fiducial imagers in the array in a preferred embodiment of the present invention is preferably equal to the number of the plurality of latch needles. Each fiducial imager is aligned with a different one of the plurality of latch needles and provides position data for the latch needle with which it is aligned. The positions of all latch needles in the plurality of latch needles are thus, preferably, simultaneously measurable by the OPM. Preferably, the number of the plurality of latch needles is equal to the number of latch needles in the knitting machine.

In some preferred embodiments of the present invention, the number of the plurality of fiducial imagers in the array of fiducial imagers of an OPM is less than the number of the plurality of latch needles whose positions are to be determined using the OPM. In order to provide position measurements for all the latch needles of the plurality of latch needles, the array of fiducial imagers in the OPM is moved along the needle bed in which the latch needles are held. Preferably, the array of fiducial imagers is moved over the needle bed in a direction collinear with the axis of the array.

In one preferred embodiment of the present invention the fiducial imager comprises a lens and a detector having a light sensitive surface that is divided into first and second regions. The areas of the two regions are preferably equal and preferably abut each other along a straight line. The straight line is preferably oriented substantially perpendicular to the direction of motion of the latch needle. The detector sends first and second signals that are functions of the amounts of reflected light from the fiducial incident on the first and second regions respectively to a controller. The lens focuses reflected light from the fiducial to form an image of the fiducial on the light sensitive surface of the detector. The portions of the image, and thereby the amounts of reflected light, that fall on the first and second regions are different for different positions of the fiducial. The first and second signals, are therefore functions of the position of the fiducial and thereby of the position of the latch needle on which the fiducial is located. The controller uses the first and second signals to determine the position of the latch needle.

In another preferred embodiment of the present invention the fiducial imager comprises a lens, a detector and a light filter. The detector comprises a light sensitive surface sensitive to light in first and second non-overlapping wavelength bands of light. The light filter has first and second filter regions. Each of the filter regions transmits light in a different one of the wavelength bands and does not transmit light in the other wavelength band. The areas of the two filter regions are preferably equal and preferably abut each other along a straight dividing line.

The lens focuses light from the fiducial illuminator that is reflected from the fiducial to form an image of the fiducial on the light sensitive surface of the detector. The filter is positioned with respect to the detector and lens so that the dividing line of the filter and the optic axis of the lens intersect and so that all light from the fiducial focused on the light sensitive surface of the detector passes through the filter. (The filter can also be comprised in an appropriate coating on the lens.) As a result reflected light from the fiducial incident on a first one half of the lens is filtered by the first filter region and reflected light from the fiducial incident on the other half of the lens, a "second half", is filtered by the second filter region. Therefore the amounts of light in the image of the fiducial in the first and second wavelength bands are proportional to the amounts of light incident on the first and second halves of the lens respectively.

Preferably, the fiducial illuminator illuminates the fiducial with substantially equal intensities of light in the first and second wavelength bands and the fiducial has substantially the same reflectivity for light in both wavelength bands. Preferably, the transmittance of the first filter region for light in the first wavelength band is substantially equal to the transmittance of the second filter region for light in the second wavelength band. Preferably, intensities registered by the light sensitive surface in the first and second wavelength bands are normalized to the intensities of light radiated by the fiducial illuminator in the first and second wavelength bands. The intensities are preferably corrected for differences in reflectivity of the fiducial in the two wavelength bands. Preferably, the intensities are corrected for differences between the transmittance of the first filter region for light in the first wavelength band and the transmittance of the second filter region for light in the second wavelength band. The intensities are preferably corrected for differences in sensitivity of the light sensitive surface to light in the two wavelength bands.

Hereinafter, when intensities, integrated intensities or amounts of light on light sensitive surfaces are compared, it is understood that they are appropriately normalized to the intensity of light radiated by the fiducial illuminator and corrected for biases introduced by various optical components.

The amounts of light incident on the first and second halves of the lens are functions of the position of the fiducial. When the fiducial is located on the optic axis of the lens the first and second halves of the lens receive the same amounts of reflected light. When the fiducial is displaced from the optic axis in the direction of one or the other halves of the lens, the half towards which the fiducial is displaced gets more light and the other half gets less light. Preferably, the dividing line of the filter is substantially perpendicular to the motion of the latch needle and thereby to the fiducial in order to maximize change in the amounts of light incident on the first and second halves of the lens with change of position of the fiducial. The first and second signals sent by the detector to the controller are therefore functions of the position of the fiducial. These signals are used by the controller to determine the position of the fiducial and the latch needle on which the fiducial is located.

In an alternate preferred embodiment of the present invention, the fiducial imager comprises two preferably identical light detectors, each having its own lens that focuses an image of the fiducial onto the detector's light sensitive surface. The two light detectors are displaced from each other by a short distance. The line between the two detectors is aligned parallel with and in the plane of the latch needle slot of the latch needle whose position the detectors are used to determine. The difference between the amounts of light from the fiducial illuminator that is reflected into each of the two detectors is different for different positions of the latch needle along the latch needles range of motion. For example, assume the fiducial illuminator is equidistant from both detectors. When the fiducial is equidistant from both detectors each detector receives the same amount of reflected light from the fiducial and the difference between the amounts of light received by the detectors is substantially zero. If the fiducial is displaced along the direction of motion of the latch needle towards one of the detectors, the detector towards which it is displaced receives an increased amount of reflected light and the other detector receives a decreased amount of light. The difference between the amounts of reflected light received by the detectors from the fiducial is a function of the displacement of the fiducial from the position of the fiducial at which both detectors receive the same amount of reflected light. This difference, and thereby the location of the fiducial and the latch needle, is determined by a circuit that receives an input signal from each detector that is a function of the intensity of light incident on the detector.

In another preferred embodiment of the present invention the fiducial imager comprises one light detector and two lenses. The light sensitive surface of the light detector is sensitive to light in two non-overlapping wavelength bands of light. The fiducial illuminator illuminates the fiducial with preferably equal intensities of light from both wavelength bands. Each of the lenses transmits light in only one of the two different wavelength bands. Both lenses focus light reflected from the fiducial onto the light sensitive surface of the detector. The lenses are displaced a short distance from each other and the line connecting the centers of the lenses is aligned parallel with and in the plane of the latch needle slot of the latch needle whose position the fiducial imager is used to determine. As in the previous fiducial imager, when the fiducial is equidistant from both lenses the detector registers equal intensity (appropriately normalized as discussed above) of light in both of the wavelength bands for which it is sensitive. As the fiducial is displaced towards one or the other of the lenses, the difference between the intensities of light registered by the detector in the two wavelength bands changes as a function of the amount of the displacement.

In a yet another preferred embodiment of the present invention, the fiducial imager comprises one light detector and a lens. The light sensitive surface of the light detector is sensitive to light in two non-overlapping wavelength bands of light. The lens transmits light in both of the two wavelength bands. The latch needle whose position is measured using the fiducial imager is provided with two fiducials displaced from each other by a short distance along the length of the latch needle. Each of the fiducials reflects light in a different one of the wavelength bands to which the detector is sensitive and absorbs light in the other wavelength band. The lens focuses both fiducials on the light sensitive surface of the light detector. The difference between the light intensity registered by the detector in the two different wavelength bands is used to determine the position of the two fiducials and thereby of the latch needle.

In still yet another preferred embodiment of the present invention, the fiducial imager comprises a monochromatic light detector having a pixelated light sensitive surface, such as a CCD, and a lens that focuses an image of the fiducial on the pixelated surface. The location of the fiducial image on the pixelated surface is determined to be the center of gravity of the illumination pattern on the surface that is caused by the fiducial image. The location of the center of gravity is determined to sub-pixel resolution from the locations of pixels illuminated by the fiducial image and the intensities with which these pixels are illuminated using techniques known in the art. The position of the fiducial and its latch needle is determined from the location of the fiducial image on the pixelated surface by techniques that are well-known in the art.

It should be realized that an OPM, in accordance with a preferred embodiment of the present invention, is useable for any application requiring position monitoring of latch needles and its use is not restricted for use only in cooperation with a DND system. It should also be realized that an OPM, in accordance with a preferred embodiment of the present invention, is useable for providing latch needle position measurements for a DND system irrespective of the type of actuators used to activate latch needles in the DND system, and is not limited to use with DND systems that use piezoelectric micromotors or actuators.

There is therefore provided in accordance with a preferred embodiment of the present invention an optical position monitor for determining the position of a latch needle in a knitting machine comprising: at least one fiducial at a known fixed location on the body of the latch needle; a fiducial imager that produces at least one optical image of the at least one fiducial on at least one light sensitive surface, wherein the at least one optical image changes with changes in position of the at least one fiducial; and a controller that receives at least one signal responsive to the changes in the at least one image and uses the at least one signal to determine the position of the at least one fiducial and thereby of the latch needle.

Preferably, the optical position monitor comprises at least one fiducial illuminator that illuminates the at least one fiducial. Additionally or alternatively, the changes in the at least one image comprise changes in integrated intensity of the at least one image. Alternatively or additionally, the at least one fiducial comprises a single fiducial.

In some preferred embodiments of the present invention the at least one light sensitive surface comprises first and second light sensitive surfaces and the at least one signal comprises first and second signals responsive to the intensity of light reflected by the at least one fiducial imaged on the first and second light sensitive surfaces respectively.

Preferably, the first and second light sensitive surfaces comprise first and second contiguous light sensitive surfaces. The at least one image preferably comprises a single image having first and second portions on the first and second light sensitive surfaces respectively and the ratio between the first and second portions depends upon the position of the at least one fiducial.

Alternatively, the first and second light sensitive surfaces comprise first and second light sensitive surfaces that are preferably displaced from each other by a distance. Preferably, the optical position monitor comprises first and second lenses and the at least one image comprises first and second images, wherein the first and second light sensitive surfaces are optically aligned with the first and second lenses respectively, and the first lens produces the first image on the first light sensitive surface and the second lens produces the second image on the second light sensitive surface and wherein the ratio between the integrated intensities of the first and second images depends upon the position of the at least one fiducial.

In still other preferred embodiments of the present invention the at least one light sensitive surface comprises a single light sensitive surface sensitive to light in first and second non-overlapping wavelength bands of light and the at least one signal comprises first and second signals responsive to the integrated intensity of light incident on the single light sensitive surface in the first and second wavelength bands respectively.

Preferably, the optical position monitor comprises a light filter having first and second filter regions wherein the first region transmits light only in the first wavelength band and the second filter region transmits light only in the second wavelength band and light reflected from the single fiducial that is imaged on the light sensitive surface, passes through either the first filter region or the second filter region.

Preferably, the at least one image comprises a single image, wherein a first portion of light in the single image reflected from the fiducial passes through the first filter region and a second portion of light in the single image reflected from the fiducial passes through the second filter region, and wherein the ratio between first and second portions depends upon the position of the fiducial.

Alternatively, the optical position monitor comprises a first lens and a second lens displaced from each other by a distance, wherein the first lens transmits light only in the first wavelength band and the second lens transmits light only in the second wavelength band, wherein the first and second lenses produce first and second images of the fiducial on the light sensitive surface respectively, and the relative integrated intensity of light in the first and second images is a function of the position of the fiducial.

In some preferred embodiments of the present invention the at least one fiducial comprises at least a first and a second fiducial. Preferably, the at least one light sensitive surface comprises a single light sensitive surface sensitive to light in first and second non-overlapping wavelength bands of light and wherein the at least one signal comprises first and second signals responsive to the integrated intensity of light incident on the single light sensitive surface in the first and second wavelength bands respectively. Preferably, the first fiducial reflects light only in the first wavelength band and the second fiducial reflects light only in the second wavelength band, and the optical position monitor comprises: a lens that produces a first image of the first fiducial and a second image of the second fiducial on the light sensitive surface using light reflected from the first and second fiducials respectively; wherein the integrated intensity of light in the first and second images depends upon the position of the first and second fiducials.

In an optical position monitor in accordance with some preferred embodiments of the present invention, changes in the at least one image comprise changes in the location of the at least one image on the at least one light sensitive surface. Preferably, the at least one light sensitive surface comprises at least one pixelated surface. Preferably, the at least one signal comprises signals responsive to the intensity of light incident on each pixel of the at least one pixelated surface. The at least one image preferably comprises a single image on each of the at least one pixelated surface. In some preferred embodiments of the present invention the at least one pixelated surface comprises a single pixelated surface.

In some preferred embodiments of the present invention a location for each of the at least one image is defined as the location of an optical center of gravity of the at least one image, which location is determined from the signals responsive to the intensity of light incident on each pixel of the at least one pixelated surface, and wherein the location of the optical center of gravity is responsive to the position of the at least one fiducial.

In some preferred embodiments of the present invention wherein changes in the at least one image comprise changes in the location of the at least one image on the at least one light sensitive surface, the at least one fiducial comprises a single fiducial.

In some preferred embodiments of the present invention the single fiducial of a plurality of latch needles is imaged on different regions of the at least one pixelated surface, and the optical position monitor is used to determine the positions of a plurality of latch needles. Preferably, the number of the plurality of latch needles is greater than 5. Alternatively, the number of the plurality of latch needles is preferably greater than 10. Alternatively, the number of the plurality of latch needles is preferably greater than 20.

In some preferred embodiments of the present invention an optical position monitor comprises a means for selectively aligning the optical position monitor with different latch needles in the needle bed.

There is further provided an optical position monitor for simultaneously monitoring the position of a plurality of latch needles in a knitting machine needle bed, which needle bed has a plane surface having latch needle slots that are parallel to each other, comprising a plurality of optical position monitors in accordance with a preferred embodiment of the present invention.

Preferably, each of the plurality of the optical position monitors is aligned with a different latch needle and is used to determine the position of at least the latch needle with which it is aligned.

The optical position monitors in the plurality of optical position monitors are preferably aligned in a line array along a straight line. Preferably, the line array is parallel to the needle bed surface and perpendicular to the latch needle slots. Alternatively or additionally, the spacing between an optical position monitor in the line array and an adjacent optical position monitor is the same for any optical position monitor in the line array. Preferably, the spacing is equal to the spacing between adjacent latch needles of the plurality of latch needles.

In some preferred embodiments of the present invention, the number of the plurality of needles is equal to the number of needles in the needle bed.

In other preferred embodiments of the present invention the number of the plurality of latch needles is less than the number of needles in the needle bed and the optical position monitor includes a means for selectively aligning the optical position monitor with different groups of latch needles in the needle bed. Preferably the means for aligning the optical position monitor with different groups of latch needles comprises means for translating the optical position monitor in a direction parallel to the needle bed and perpendicular to the latch needle slots.

In some preferred embodiments of the present invention the optically reflective fiducial comprises at least two regions on the surface of the latch needle having different reflectivities. Preferably, at least one of the at least two regions comprises a retroreflector. Alternatively or additionally, at least one of the at least two regions comprises at least one discontinuity in the surface of the latch needle. Preferably, the at least one discontinuity comprises at least one straight line groove on the surface of the latch needle. Alternatively or additionally, the discontinuity preferably comprises at least one dimple depressed into the surface of the latch needle. Alternatively or additionally, at least one of the at least two regions is preferably substantially non-reflecting.

Additionally or alternatively, light reflected from the fiducial is substantially confined within a cone of half energy angle less than 20°. Additionally or alternatively light reflected from the fiducial is substantially confined within a cone of half energy angle less than 15°. Additionally or alternatively, light reflected from the fiducial is substantially confined within a cone of half energy angle less than 10°.

There is further provided an actuator system for activating a latch needle, which latch needle has a shaft, comprising: a flat planar extension of the shaft having first and second parallel planar surfaces; at least one piezoelectric micromotor having a first surface region for transmitting motion to a moveable element, which first surface region is resiliently pressed to the first surface and at least one additional piezoelectric motor having a second surface region for transmitting motion to a moveable element which second surface region is resiliently pressed to the second surface; and wherein vibratory motions of the first and second surface regions apply forces to the flat extension that cause motion in the latch needle.

There is also provided an actuator system for activating a latch needle, which latch needle has a thin flat shaft comprising: a flat planar extension of the shaft having first and second planar surfaces; a piezoelectric micromotor having a surface region for transmitting motion to a moveable element; a transmission bracket for holding the piezoelectric micromotor, the transmission bracket comprising a bearing surface and a means for resiliently urging the surface region of the piezoelectric micromotor towards the bearing surface; and wherein the flat extension is inserted between the surface region of the piezoelectric micromotor and the bearing or the non-stick surface and wherein vibratory motion of the surface region applies force to the flat extension causing motion in the latch needle.

Preferably, the bearing surface is the surface of a rotatable roller or ball. Alternatively or additionally, the bearing surface is a surface having a low friction coating.

In an actuator system for activating a latch needle according to some preferred embodiments of the present invention, the surface region for transmitting motion to a moveable element comprises a wear resistant nub that makes contact with a surface of the moveable element towards which the surface region for transmitting motion is resiliently pressed in order to transmit motion to the moveable element.

In an actuator system for activating a latch needle according to some preferred embodiments of the present invention, points on surfaces of the flat extension at which said surface regions of the piezoelectric micromotors make contact are clad in wear resistant material.

BRIEF DESCRIPTION OF FIGURES

The invention will be more clearly understood by reference to the following description of preferred embodiments thereof read in conjunction with the attached figures listed below, wherein identical structures, elements or parts that appear in more than one of the figures are labeled with the same numeral in all the figures in which they appear, and in which.

DETAILED DESCRIPTION OF PREFERRED EMBODIMENTS

Figure 1:
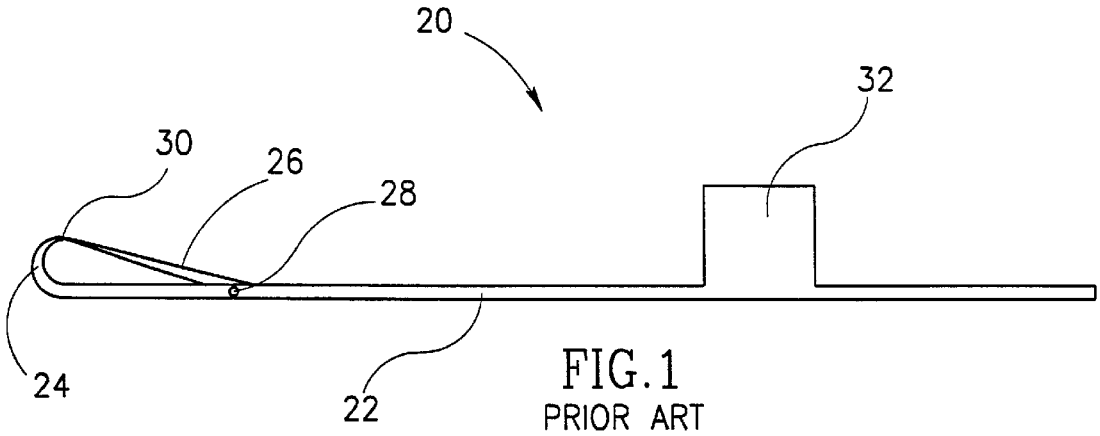
FIG.1 PRIOR ART
FIG. 1 shows the basic structure of a latch needle.

FIG. 1 shows a profile of a latch needle 20. Latch needle 20 is a thin metallic structure with a long shaft 22 having a hook 24 and a tip 30 formed on one of its ends. A latch 26 is rotatable about a pivot 28 and is shown in the figure in the position where it caps tip 30 to close hook 24 and prevents hook 24 from hooking a thread. In an open position latch 26 is rotated clockwise almost to a position where it is parallel to shaft 22. A fin 32 extends out from shaft 22, generally on the same side of shaft 22 as hook 24.

Figure 2:
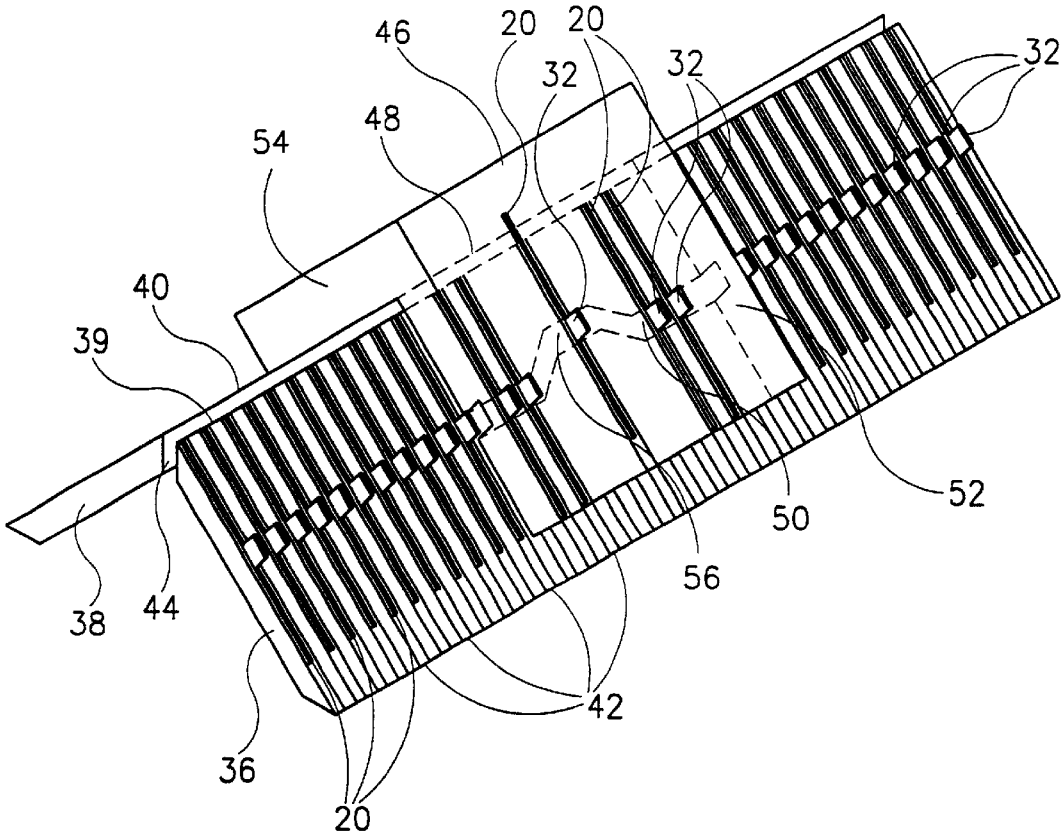
FIG.2 PRIOR ART
FIG. 2 is a schematic illustration of a conventional system for activating latch needles in a knitting machine.

FIG. 2 is a schematic illustration of the arrangement of needle beds in a conventional knitting machine and a shuttle which transmits motion to latch needles in the needle beds.

Two needle beds 36 and 38 are rigidly joined at an angle to each other so that an edge 39 of needle bed 36 is close to and parallel to an edge 40 of needle bed 38. A long narrow space 44 separates edge 39 and edge 40. Needle beds 36 and 38 are identical or very similar and detailed discussion will be confined to needle bed 36 with the understanding that details and structures described for needle bed 36 apply equally to needle bed 38.

Threads to be woven into fabric (not shown) are held under tension close to and parallel to edges 39 and 40. Fabric (not shown), as it is produced moves downwardly from edges 39 and 40 into space 44. As the fabric moves down it exits the knitting machine.

Needle bed 36 is provided with an array of equally spaced parallel latch needle slots 42 that are perpendicular to edge 39. A latch needle 20 is placed in each latch needle slot 42. The bodies of latch needles 20 are completely inside latch needle slots 42 and are not visible. Only fins 32 of latch needles 20 protrude above the surface of needle bed 36 and are visible. Fins 32 of all latch needles 20 that are at rest in slots 42 are aligned along a straight row which is perpendicular to latch needle slots 42. Each needle 20 is moveable back and forth in its latch needle slot 42.

A shuttle 46, having ends 52 and 54, moves back and forth parallel to edges 39 and 40 along the length of needle bed 36. An interior face 48 of shuttle 46 is parallel to needle bed 36 and has a channel 50 formed in the face. Channel 50 is open on both ends 52 and 54 of shuttle 46. The two open ends of channel 50 are in line with the row of fins 32. A section 56 of channel 50 is not collinear with the ends of channel 50. Channel 50 is just wide enough and deep enough so that fins 32 can pass into and move through it.

As shuttle 46 moves back and forth with interior face 48 parallel to latch needle bed 36, fins 32 of latch needles 20 enter channel 50 at one end and move along the length of channel 50. When a fin 32 of a latch needle 20 encounters non-collinear section 56 of channel 50 the fin 32 and the latch needle 20 to which fin 32 is attached are displaced parallel to latch needle slot 42 in which the latch needle 20 is found. In FIG. 2, for clarity of presentation, only a few of latch needles 20 that are moving in channel 50 are shown.

Figure 3:
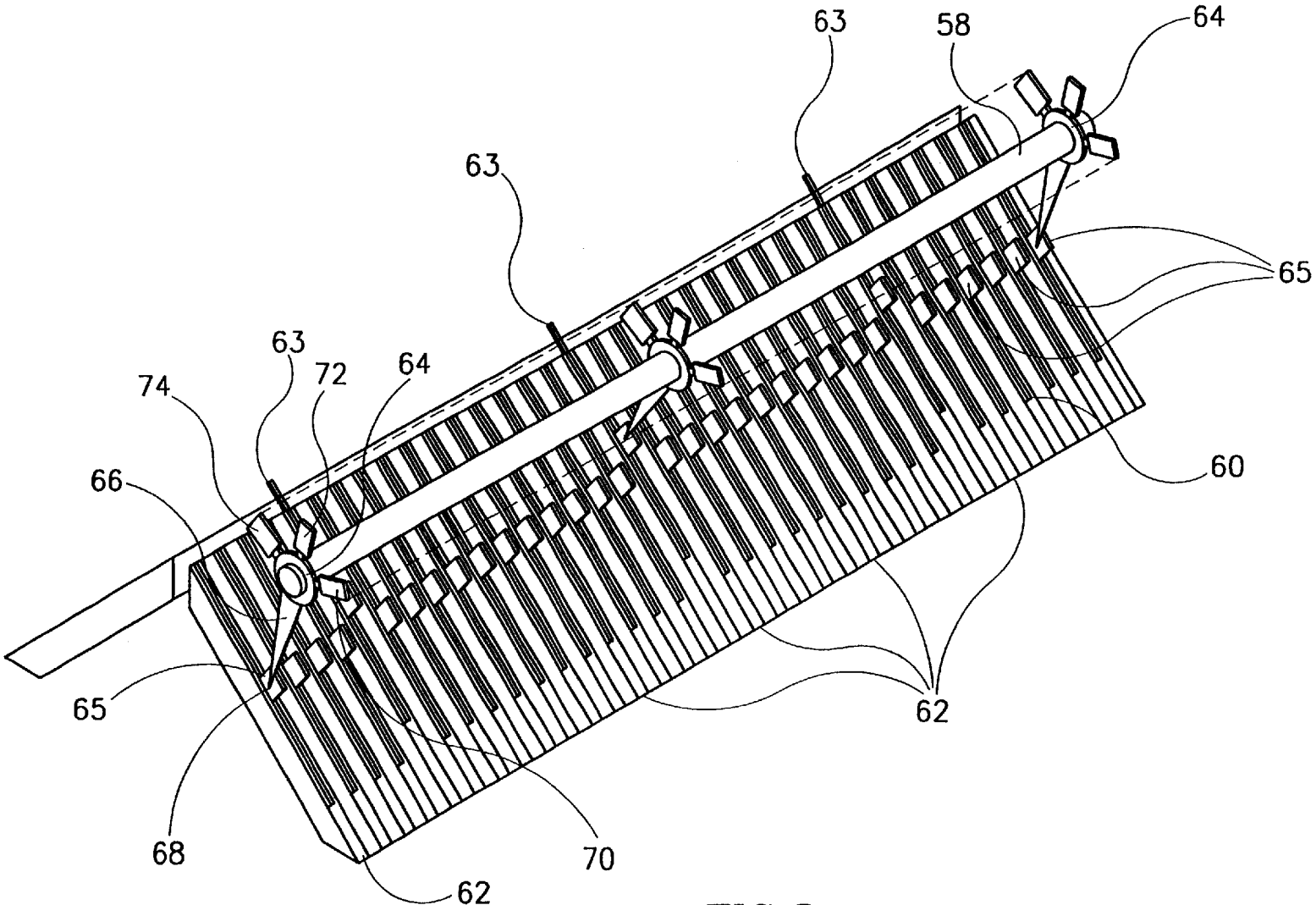
FIG. 3 is a schematic illustration of a system for coupling piezoelectric micromotors to latch needles in a needle bed by rotary transmission, in accordance with a preferred embodiment of the present invention.

FIG. 3 shows a system for exclusively coupling each of the latch needles in a needle bed to at least one exclusive piezoelectric micromotor using a rotary transmission, according to a preferred embodiment of the present invention. A long bearing shaft 58 is mounted over a needle bed 60 that is provided with slots 62 into which have been placed latch needles 63. Bearing shaft 58 is mounted with a multiplicity of thin annuli 64, one annulus for each latch needle (for clarity only three are shown). The annuli rotate freely on bearing shaft 58. Each annulus is positioned opposite a fin 65 of a particular latch needle 63. A connecting arm 66 connects each annulus 64 to a point 68 on fin 65, to which annulus 64 is opposite. The connection at point 68 is a flexible or slideable connection produced by methods known in the art. One or more piezoelectric micromotors 70, 72, and 74, are resiliently pressed against each annulus 64 by methods known in the art. When piezoelectric micromotors 70, 72, and 74, are activated they cause annulus 64 and connecting arm 66 to rotate, which in turn moves latch needle 63 linearly in its slot 62. The flexible connection at point 68 translates rotational motion of arm 66 to linear motion of latch needle 63. It should be understood that this arrangement allows for a much higher speed of the latch needle than that available from the motor itself.

While three exclusive piezoelectric micromotors are shown coupled to annulus 64 in FIG. 3, a greater or lesser number of micromotors can be used depending on the speed or torque required for motion of the needle. Also, other types of piezoelectric micromotors constructed differently than the ones shown in FIG. 3 and described above may be used to rotate annulus 64 and are advantageous. U.S. Pat. No. 4,562,374 and the publication by Hiroshi et al., IEEE Transactions on Ultrasonics, Ferroelectrics, and Frequency Control, Vol. 42, No. 2, March 1995, incorporated herein by reference, describe rotary piezoelectric micromotors. These rotary piezoelectric micromotors comprise a cylindrical, annular or disc shaped rotor that is caused to rotate by coupling to a stator that is a cylindrical, annular or disc shaped vibrator. The rotor and stator are concentric. A vibrating surface of the stator is coupled to an inside edge surface or an outside edge surface of the rotor to impart a rotary motion to it. Alternatively, a vibrating surface of the stator may be coupled to a face surface of the rotor to impart rotational motion to the rotor. Annulus 64 can be rotated by the use of stators similar to those described in the above references. Annulus 64 is coupled to the stators in similar fashion to the way that the rotors are coupled to the stators in the described rotary piezoelectric micromotors.

Figure 4:
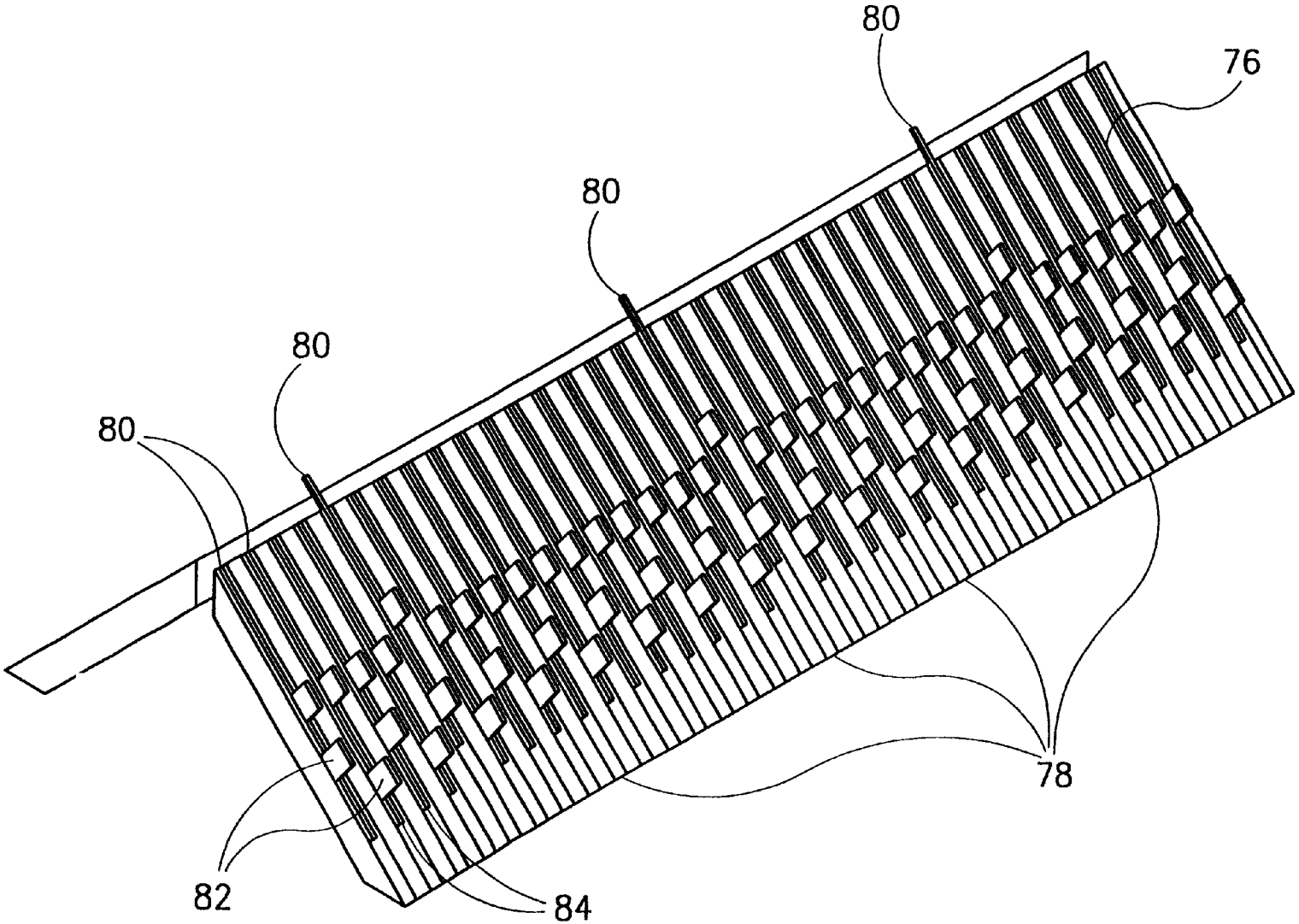
FIG. 4 shows a schematic of a system for coupling piezoelectric micromotors to latch needles in a needle bed by linear transmission in accordance with an alternative preferred embodiment of the present invention.

FIG. 4 shows another system for coupling each of the latch needles in a needle bed to at least one exclusive piezoelectric micromotor using a linear transmission, according to an alternative preferred embodiment of the present invention.

A latch needle bed 76 is provided with latch needle slots 78 in which are placed latch needles 80. One or more thin piezoelectric micromotor 82 is resiliently pressed against the shaft 84 of each latch needle 80 (only one is shown for each latch needle for simplicity). Piezoelectric micromotors 82 on adjacent latch needles 80 are in line with each other so that they form a straight row. Alternatively, piezoelectric micromotors 82 may be staggered with respect to each other so that they are arrayed in two or more parallel rows. FIG. 4 shows an embodiment according to the present invention in which piezoelectric micromotors are aligned in two parallel rows. Staggered configurations allow for more space between closely packed vibrators 82 than would be available if vibrators 82 were arrayed in a single row and thus allow for thicker more powerful piezoelectric micromotors to be coupled to latch needles 63.

Vibrations of piezoelectric micromotors 82 are directly translated into linear motion of latch needles 80. Slots 78 are fitted with bearings (not shown) or with a non-stick surface so that the resilient force which presses a vibrator 82 to a shaft 84 of a needle 80 does not result in excessive friction between needle 80 and the bottom or sides of latch needle slot 78 in which needle 80 is placed.

Rotary piezoelectric micromotors similar to those described in U.S. Pat. No. 4,562,374 and the publication by Hiroshi et al. cited above may also be used to drive latch needles 80. The edge surface of a rotor of a rotary piezoelectric micromotor is resiliently pressed against shaft 84 of each latch needle 80. The axes of the rotors are perpendicular to latch needle slots 78 in which latch needles 80 are placed. Frictional forces at the area of contact between the edge surface of a rotor and the surface of shaft 84 of a needle 80 acts to prevent the edge surface of the rotor from slipping on the surface of shaft 84 when the rotor rotates. As the rotor rotates it therefore causes shaft 84 of latch needle 80 to displace linearly in latch needle slot 78 in which latch needle 80 is placed in the direction of motion of the mass points of the edge surface of the rotor which are in contact with the surface of shaft 84.

Figure 5:
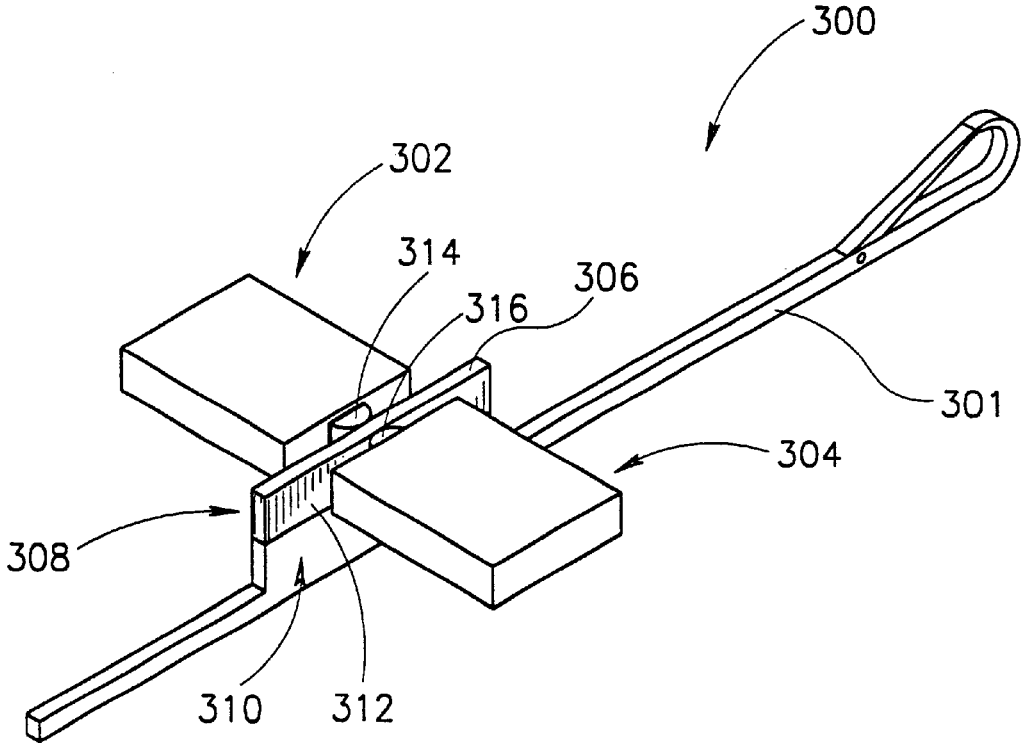
FIG. 5 illustrates schematically the coupling of a latch needle with a coupling fin to two piezoelectric micromotors in accordance with a preferred embodiment of the present invention.

FIG. 5 shows a latch needle 300 coupled to two identical piezoelectric micromotors 302 and 304, in accordance with yet another preferred embodiment of the present invention. Latch needle 300 comprises a latch needle shaft 301 and a coupling fin 306. Coupling fin 306 has two parallel planar surfaces 308 and 310. A coupling region 312 of each surface 308 and 310 (coupling region 312 of surface 308 is not seen in the perspective of FIG. 5) is preferably clad with a wear resistant material suitable for friction coupling with piezoelectric micromotors.

Piezoelectric micromotors 302 and 304 preferably comprise friction nubs 314 and 316 respectively. Piezoelectric micromotors 302 and 304 are resiliently pressed to coupling fin 306 so that friction nubs 314 and 316 contact coupling regions 312 of surfaces 308 and 310 respectively at points that are directly opposite each other. In order to move latch needle 300 back and forth in its latch needle slot (not shown) piezoelectric micromotors 302 and 304 are preferably simultaneously activated in phase to transmit motion to coupling fin 306.

Figure 6:
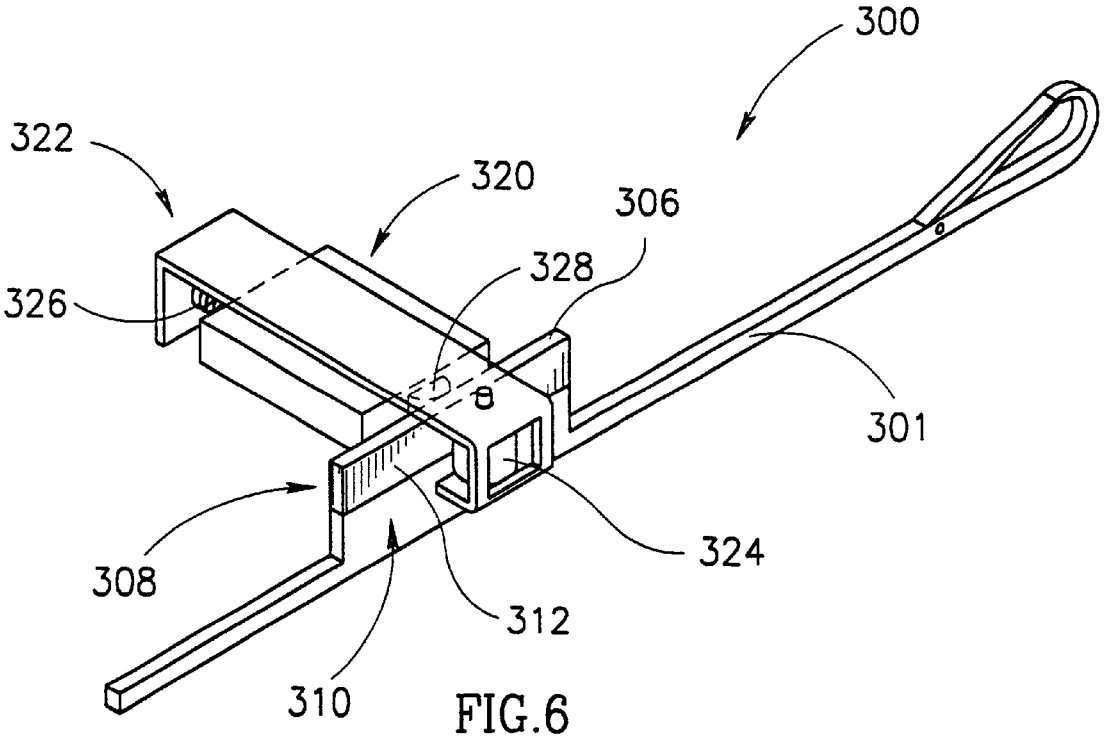
FIG. 6 illustrates schematically the coupling of a latch needle with a coupling fin to a single piezoelectric micromotor mounted to a transmission bracket in accordance with yet another preferred embodiment of the present invention.

FIG. 6 shows latch needle 300 coupled to a single piezoelectric micromotor 320, in accordance with still another preferred embodiment of the present invention. Piezoelectric micromotor 320 is mounted to a transmission bracket 322 preferably comprising a bearing 324 and a biasing means 326 such as a spring or resilient pad. Dashed lines indicate parts of piezoelectric micromotor 320 hidden by transmission bracket 322. Piezoelectric micromotor 320 preferably comprises a friction nub 328 (shown in dashed lines). Biasing means 326 resiliently presses piezoelectric micromotor 320 in a direction so that friction nub 328 is urged towards bearing 324. Transmission bracket 322 is held by an appropriate mechanical structure (not shown) so that coupling fin 306 is located between friction nub 328 and bearing 324.

As a result of the action of biasing means 326 bearing 324 presses resiliently on coupling region 312 of surface 310 and friction nub 328 presses resiliently on coupling region 312 of surface 308. Transmission bracket 322 is oriented so that the direction in which friction nub 328 is urged by biasing means 326 is substantially perpendicular to the plane of coupling fin 306. Bearing 324 and friction nub 328 exert equal and opposite forces on coupling fin 306 perpendicular to the plane of coupling fin 306. As a result piezoelectric micromotor 320 does not produce a torque on latch needle 300 that tends to rotate latch needle 300 in its latch needle slot (not shown).

Coupling fin 306 can be located at different positions along shaft 301 of different latch needles 300. In addition coupling fin 306 can be formed so that it extends different distances from shaft 301 of different latch needles 300. Adjacent latch needles in a needle bed can therefore preferably, have coupling fins that protrude different heights above the needle bed and/or are displaced with respect to each other in a direction parallel to their shafts in order to provide space for piezoelectric micromotors that are coupled to the coupling fins.

It is clear from the above discussion that piezoelectric micromotors in accordance with preferred embodiments of the present invention can be conveniently coupled to latch needles in a latch needle bed of a knitting machine so that each latch needle is exclusively coupled to at least one piezoelectric micromotor.

Figure 7A:
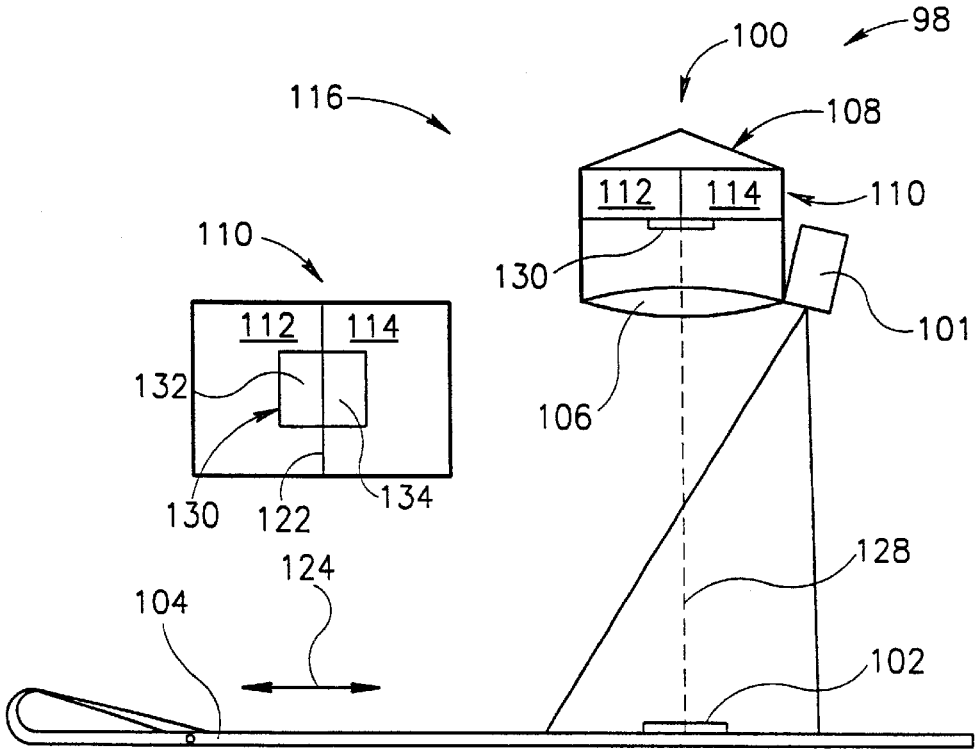
FIGS. 7A–7C schematically illustrate an OPM comprising a single fiducial imager, imaging a latch needle fiducial, in accordance with a preferred embodiment of the present invention.
Figure 7B:
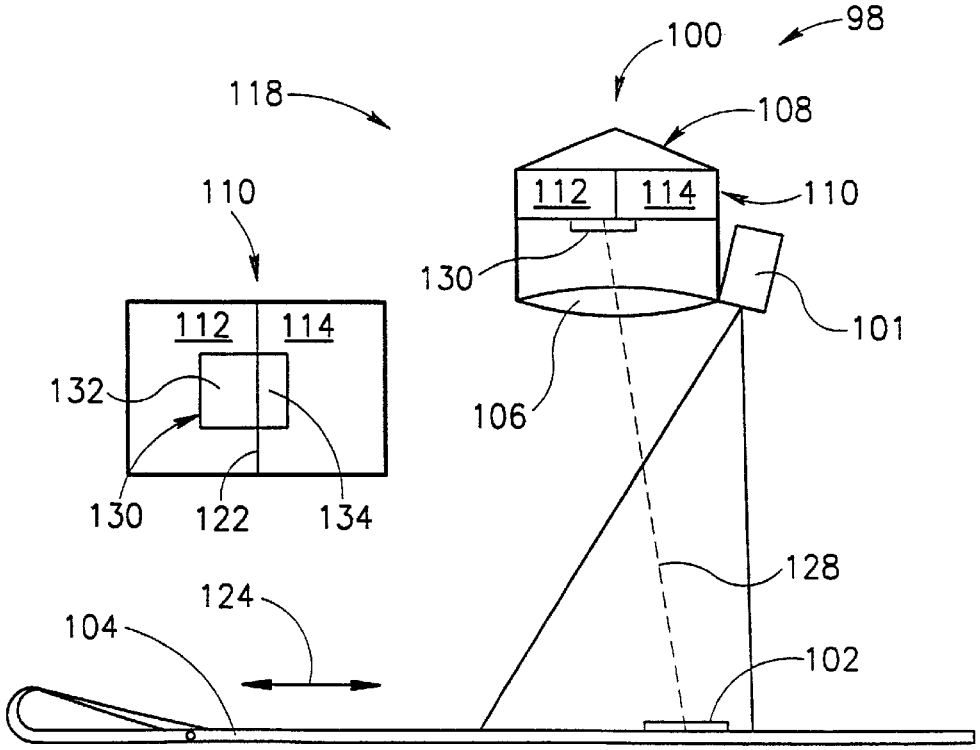
Figure 7C:
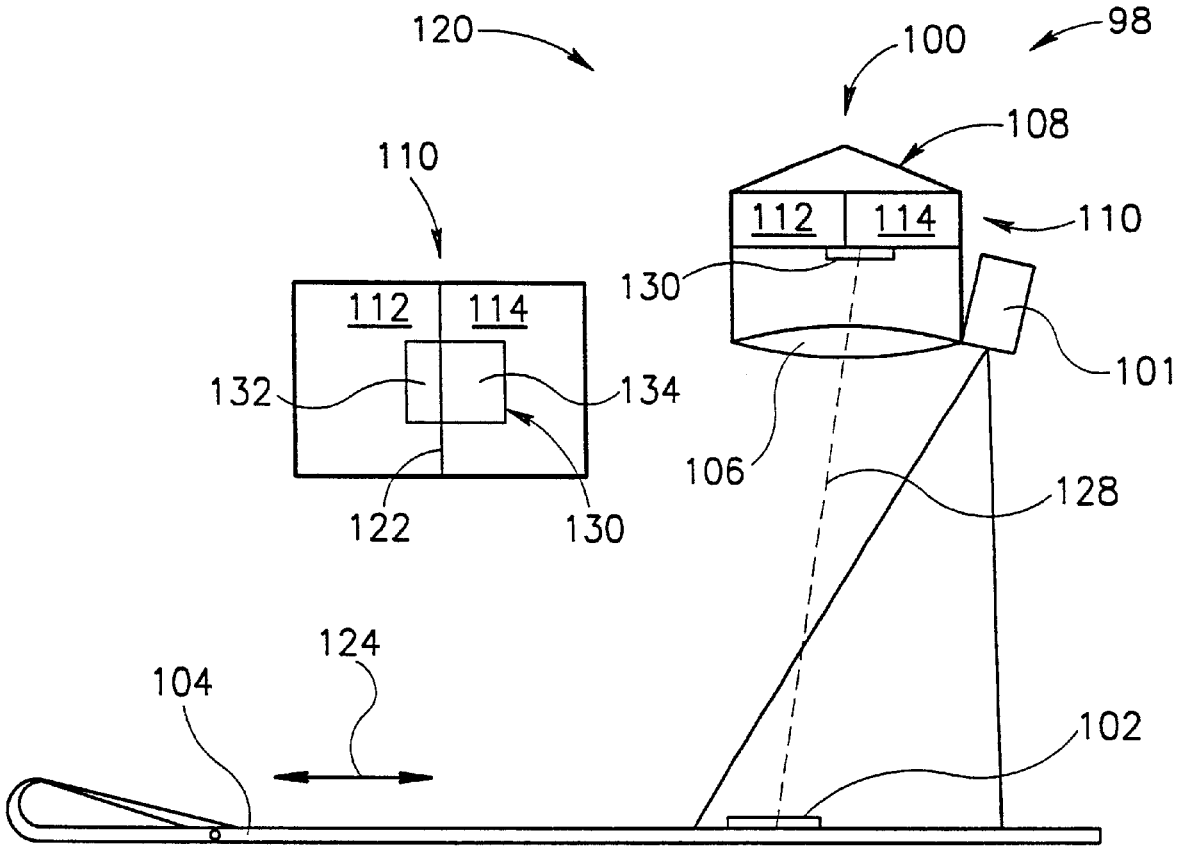

FIGS. 7A–7C schematically illustrate an OPM 98 comprising a fiducial imager 100 and a fiducial illuminator 101 imaging a latch needle fiducial 102 located on a latch needle 104, in accordance with a preferred embodiment of the present invention. Fiducial imager 100 comprises a lens 106 and a detector 108. Detector 108 has a light sensitive surface 110 (shown greatly exaggerated in thickness for convenience and clarity of presentation) that is divided into a first detector region 112 and a second detector region 114. A region of Light sensitive region 110 is schematically shown from "underneath", in a ventral view, as seen from fiducial 102, in views 116, 118 and 120 to the left of detector 108 in each of FIGS. 7A–7C respectively. The areas of detector regions 112 and 114 preferably have the same shape, are equal and abut each other along a straight dividing line 122. Detector 108 registers the intensity of light incident on first detector region 112 and second detector region 114 separately. Detector 108 sends a first signal to a controller (not shown) that is a function of the intensity of light registered on first detector region 112 and a second signal to the controller that is a function of the intensity of light registered by second detector region 114.

Detector 108 is oriented with respect to latch needle 104 so that dividing line 122 is substantially perpendicular to the plane (the same as the plane of FIGS. 7A–7C) of the latch needle slot (not shown,) in which latch needle 104 is held, and perpendicular to the direction of the back and forth motion of latch needle 104 indicated by doubled headed arrow 124.

Fiducial 102 is illuminated by light from fiducial illuminator 101 and reflects some of the light, indicated by dotted line 128, onto lens 106. Fiducial 102 preferably reflects light from fiducial illuminator 101 diffusely in a cone (not shown) of half energy angle on the order of 10°–15°. Fiducial illuminator 101 and fiducial imager 100 are located with respect to each other so that for any position of latch needle 104 in the operating range of motion of latch needle 104, fiducial 102 reflects light from fiducial illuminator 101 into fiducial imager 100.

Lens 106 forms an image 130 of fiducial 102 on light sensitive surface 110 from the light reflected by fiducial 102. A first image portion 132 of image 130 falls on first detector region 112 and a second image portion 134 of image 130 falls on second detector region 114 (views 116, 118 and 120). First detector region 112 registers an intensity of light on its surface that is a function of the size of first image portion 130 and second detector region 114 registers an intensity of light that is a function of the size of second image portion 134. Detector 108 therefore sends a first signal to the controller that is as function of the size of first image portion 130 and a second signal to the controller that is a function of the size of second image portion 134. The relative sizes of first image portion 132 and second image portion 134 are a function of the position of fiducial 102 and first and second signals are used by the controller to determine the position of fiducial 102 and thereby of latch needle 104.

The dependence of the sizes of first image portion 132 and second image portion 134 on the position of fiducial 102 is shown schematically in ventral views (seen from "beneath", from the perspective of fiducial 102) 116, 118 and 120 in FIGS. 7A–7C respectively. In FIG. 7A fiducial 102 is located along the axis of fiducial imager 100, which is coincident with the direction of line 128 that indicates the direction of reflected light from fiducial 102. First image portion 132 and second image portion 134 are equal. In FIG. 7B fiducial 102 is shown displaced far to the right of the axis of fiducial imager 100 and first image portion 132 is much larger than second image portion 134. In FIG. 7C fiducial 102 is shown displaced far to the left of the axis of fiducial imager 102 and second image portion 134 is much larger than first image portion 132.

Figure 8:
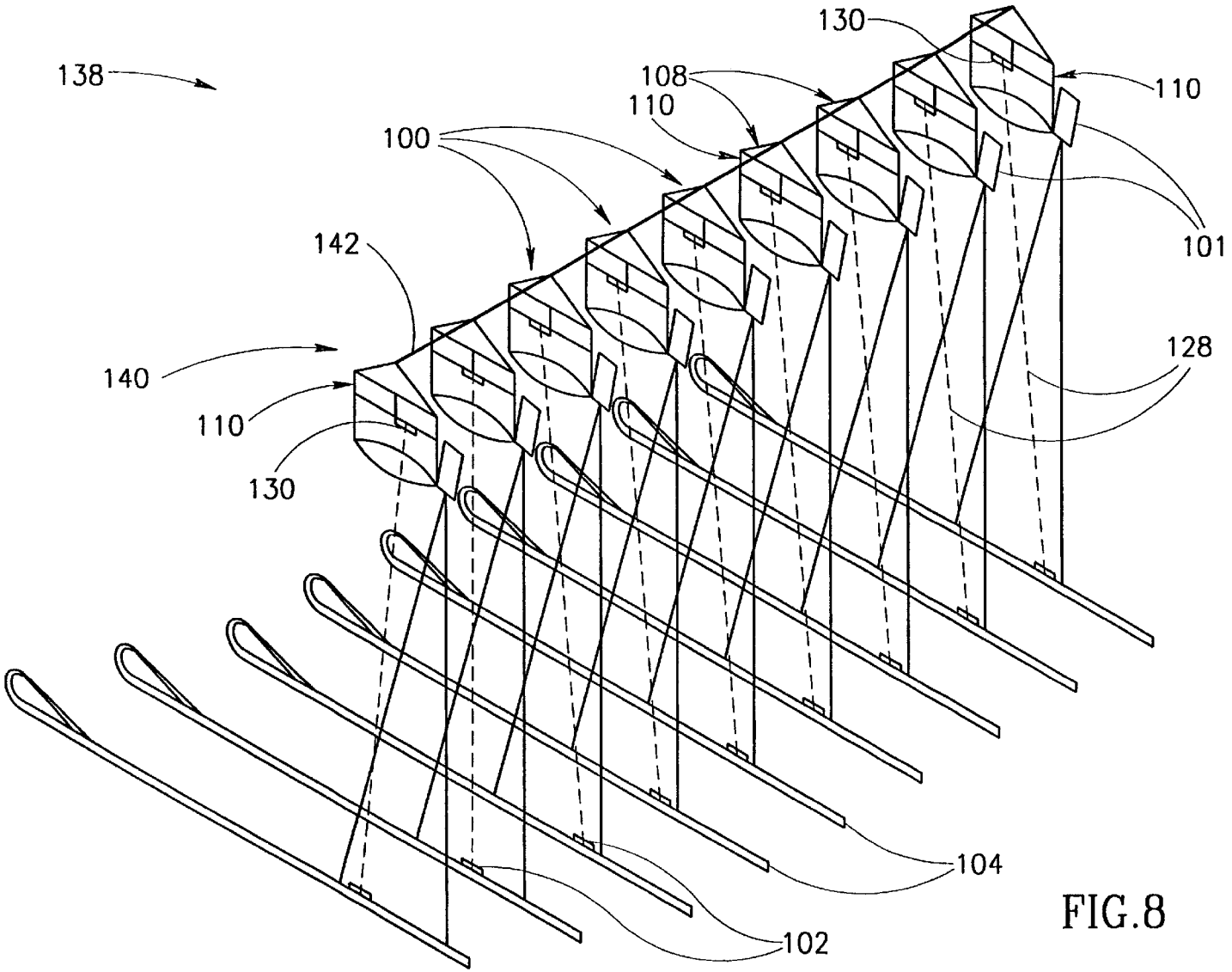
FIG. 8 schematically illustrates an OPM comprising a linear array of a plurality of imaging fiducials shown in FIGS. 7A–7C, imaging an equal plurality of latch needle fiducials in accordance with a preferred embodiment of the present invention.

FIG. 8 shows an OPM 138, in accordance with a preferred embodiment of the present invention, that comprises a plurality of fiducial imagers 100 shown in FIGS. 7A–7C. Fiducial imagers 100 are fixed with respect to each other by an appropriate mechanical structure (not shown) in a collinear line array 140 having an axis 142. Line array 140 is mounted over a needle bed (not shown) of a knitting machine (not shown) in which a plurality of latch needles 104 are placed. Each latch needle 104 has a fiducial 102. Axis 142 of line array 140 is preferably parallel to the surface of the needle bed and perpendicular to latch needles 104 (and thereby perpendicular to the directions of motion of latch needles 104). Dividing lines 122 (not shown) of light sensitive surfaces 110 of fiducial imagers 100 are preferably parallel to axis 142. Each of fiducial imagers 100 in line array 140 is aligned over a different one of latch needles 104 and is used to measure the position of latch needle 104 over which it is aligned.

In OPM 138, each fiducial 102 is illuminated with light from a fiducial illuminator 101 and reflects some of this light into the fiducial imager 100 that is aligned over and images the fiducial 102. A central ray of light from each fiducial 102 reflected into the fiducial imager 100 that images the fiducial 102 is indicated by a dotted line 128. Each dotted line 128 starts at a fiducial 102, and ends on the image 130 of the fiducial 102 in the fiducial imager 100 that is used to measure the position of fiducial 102. The positions of the first and second leftmost latch needles 104 and their fiducials 102 in FIG. 8 correspond to the positions of latch needles 104 and fiducials 102 shown in FIGS. 7C and 7A respectively. The positions of the rest of latch needles 104 shown in FIG. 8 correspond to the position of latch needle 104 shown in FIG. 7B.

OPM 138 can be used to determine positions only for those latch needles 104 that are aligned with a fiducial imager 100 of line array 140. At any one time therefore, the number of latch needles 104 in a knitting machine whose positions can be determined by OPM 138 is equal to the number of fiducial imagers in line array 140. Preferably, the number of fiducial imagers 100 in line array 140 is equal to the number of latch needles in the knitting machine. If the number of the fiducial imagers in line array 140 is less than the number of latch needles in the knitting machine, OPM 138 must be moved in order to provide position measurements for all latch needles 104 in the knitting machine. Preferably, OPM 138 is moved parallel to axis 142 along the knitting machine needle bed in order to provide position measurements for all the latch needles 104 in the knitting machine.

In FIG. 8 each fiducial 102 is shown illuminated by its own fiducial illuminator 101. This is not a necessity and some OPMs, in accordance with preferred embodiments of the present invention, comprise fiducial illuminators that illuminate groups of more than one fiducial 102. Additionally, in some preferred embodiments of the present invention, lenses 106, each of which is used to image one fiducial 102, are replaced by lenses, such as extended cylindrical lenses, each of which is used to image more than one fiducial 102.

Figure 9A:
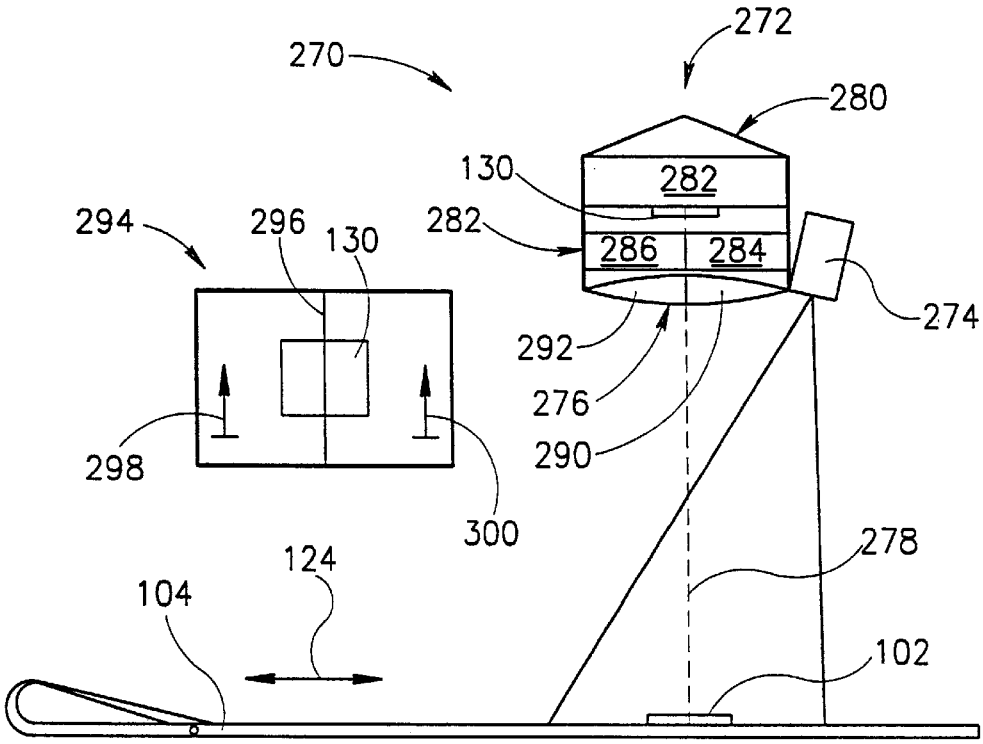
FIGS. 9A–9C schematically illustrate an OPM comprising a single fiducial imager, imaging a latch needle fiducial, in accordance with an alternative preferred embodiment of the present invention.
Figure 9B:
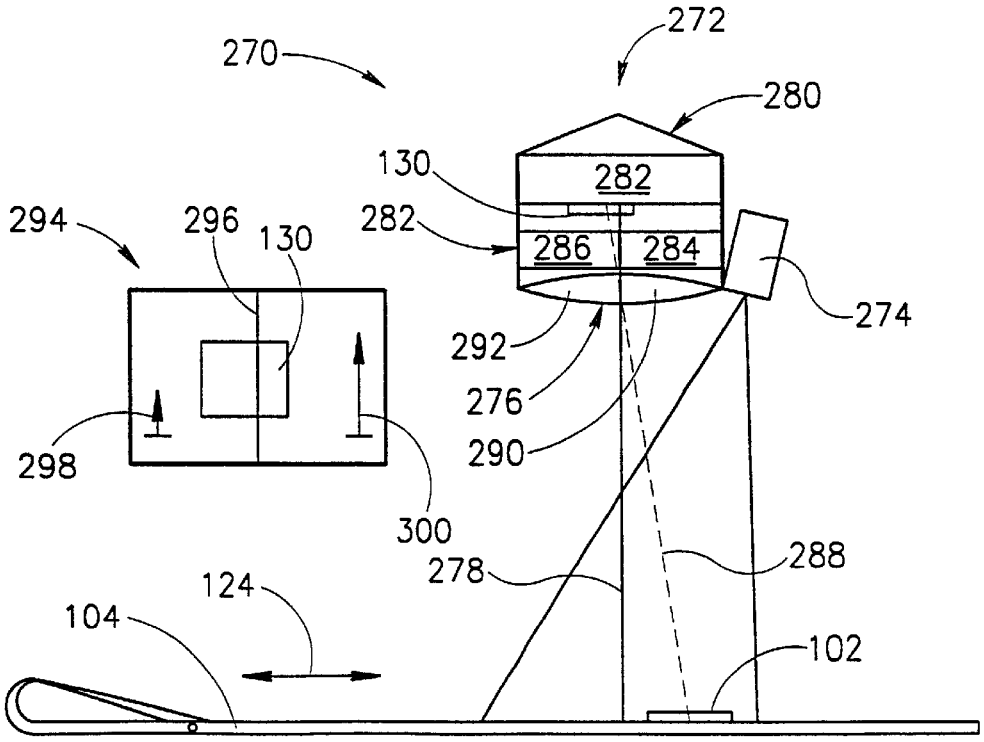
Figure 9C:
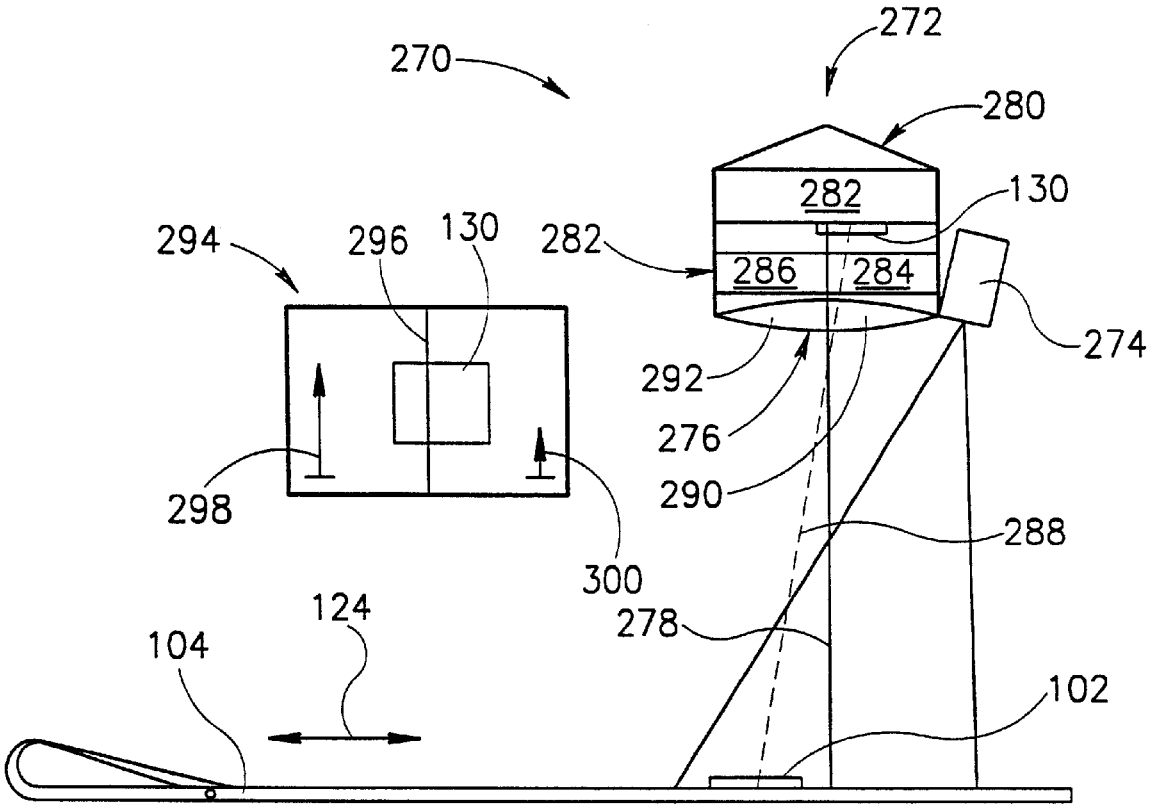

FIGS. 9A–9C schematically illustrate an OPM 270 imaging fiducial 102 of latch needle 104, in accordance with an alternate preferred embodiment of the present invention. OPM 270 comprises a fiducial imager 272 and a fiducial illuminator 274. Fiducial imager 272 comprises a lens 276 having an optic axis indicated by line 278, a detector 280 and a light filter 282. Detector 280 comprises a light sensitive surface 282, sensitive to light in first and second non-overlapping wavelength bands of light. Detector 280 sends a first signal to a controller (not shown) that is a function of the intensity of light registered on light sensitive surface 280 in the first wavelength band and a second signal to the controller that is a function of the intensity registered by light sensitive surface 282 in the second wavelength band.

Light filter 282 has a first filter region 284 and a second filter region 286. First filter region 284 transmits light only in the first wavelength band and second filter region 286 transmits light only in the second wavelength band. First and second filter regions 284 and 286 are preferably equal and abut each other along a straight dividing line (not shown in fiducial imager 272). Filter 282 is oriented with respect to lens 276 so that reflected light from fiducial 102 incident on lens 276 passes through filter 282. A central ray of reflected light from fiducial 102 is indicated by dotted line 288 in FIGS. 9B and 9C. In FIG. 9A the central ray is coincident with optic axis 278. The dividing line of filter 282 and optic axis 278 of lens 276 intersect. Preferably, the dividing line is perpendicular to the direction of motion of latch needle 104 and the plane (the plane of the FIG. ) of the latch needle slot (not shown) that holds latch needle 104. As a result, light incident on a first half 290 of lens 276 is filtered by first filter region 284 and light incident on a second half 292 of lens 276 is filtered by second filter region 286. Lens 276 focuses reflected light from fiducial 102 to form an image 130 of fiducial 102 on light sensitive surface 282 of detector 280. A first portion of the intensity of image 130 results from light incident on first half 290 of lens 276 and a second portion of the intensity of image 130 results from light incident on second half 292 of lens 276. Since first half 290 of lens 276 is filtered by first filter region 284, the first portion of the intensity of image 130 results from light in the first wavelength band. Similarly, the second portion of the intensity of image 130 results from light in the second wavelength band. The first and second portions of the intensity of image 130 are proportional to the amounts of light from fiducial 102 that are incident on first and second halves 290 and 292 of lens 276 respectively. As a result, the intensities of light registered by light sensitive surface 282 in the first and second wavelength bands are proportional to the amounts of reflected light from fiducial 102 incident on first and second halves 290 and 292 of lens 276 respectively.

However, the amounts of light incident on first half 290 and second half 292 are functions of the location of fiducial 102 with respect to optic axis 278 of lens 276. When fiducial 102 is on optic axis 278, halves 290 and 292 of lens 276 receive the same amounts of reflected light. When fiducial 102 is displaced along the direction of motion of latch needle 104 (along the direction of double headed arrow 124 in FIGS. 9A–9C) towards one or the other of halves 290 and 292, the half towards which fiducial 102 is displaced receives more light and the other half less light. This is because the distance from fiducial 102 to the half of lens 276 towards which fiducial 102 is displaced decreases and the distance towards the other half increases. The first and second signals that detector 280 sends to the controller are therefore functions of the position of fiducial 102. These signals are used by the controller to determine the position of fiducial 102 and latch needle 104 on which fiducial 102 is located.

FIGS. 9A–9C show schematically the relationship between positions of fiducial 102 and the intensities of image 130 in the first and second wavelength bands A region of light sensitive surface 282 is shown schematically with image 130, in ventral view, in a view 294 in each of FIGS. 9A–9C. The dividing line of filter 282 is shown as line 296 in view 294. The relative intensities of image 130 in the first and second wavelength bands are represented schematically in greatly exaggerated scale and only qualitatively in proportion to the actual intensities of light in image 130 in the first and second wavelength bands by the size of arrows 298 and 300 respectively.

In FIG. 9A fiducial 102 is located on optic axis 278 and image 130 has the same (appropriately normalized and corrected) integrated intensity (i.e. integrated over the area of image 130) in both wavelength bands. Arrows 298 and 300 are shown the same size. In FIG. 9B fiducial 102 is displaced away from optic axis 278 towards first half 290 of lens 276. Image 130 is displaced from optic axis 278 in the opposite direction and the integrated intensity of image 130 increases in the first wavelength band and decreases in the second wavelength band. Arrow 300 is shown much larger than arrow 298. Similarly, in FIG. 9C, fiducial 102 is shown displaced away from optic axis 278 towards second half 292 of lens 276. The integrated intensity of image 130 increases in the second wavelength band and decreases in the first wavelength band.

Figure 10A:
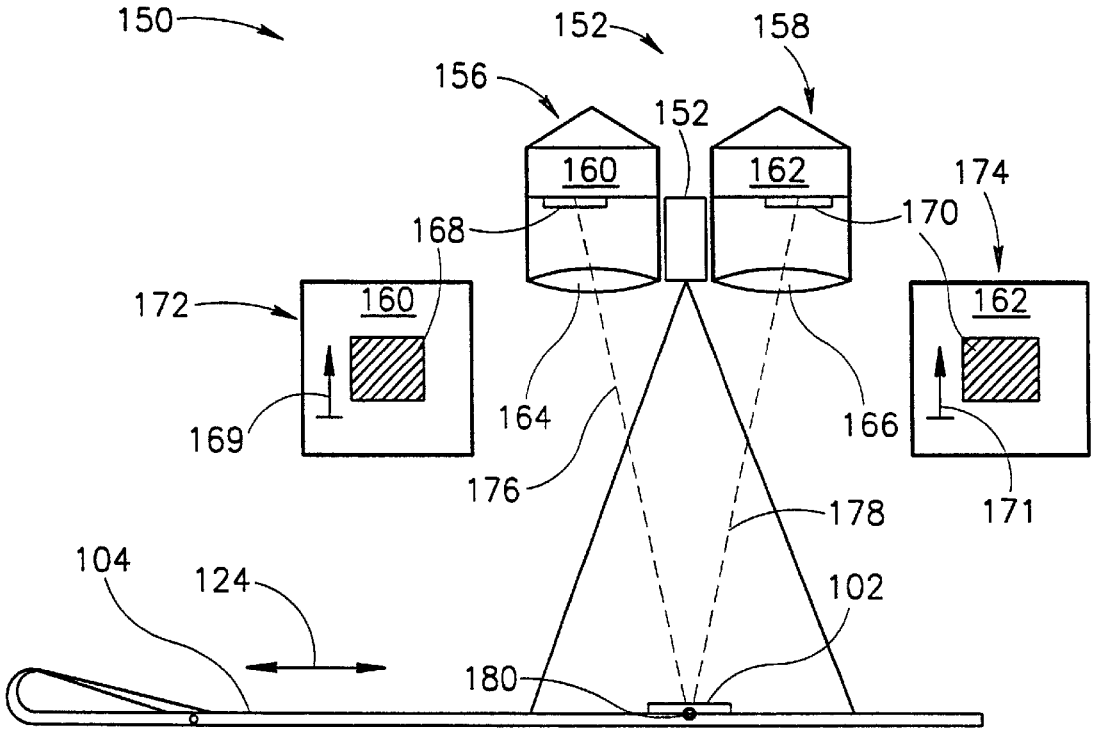
FIGS. 10A–10C schematically illustrate an OPM comprising a single fiducial imager, imaging a latch needle fiducial, in accordance with another preferred embodiment of the present invention.
Figure 10B:
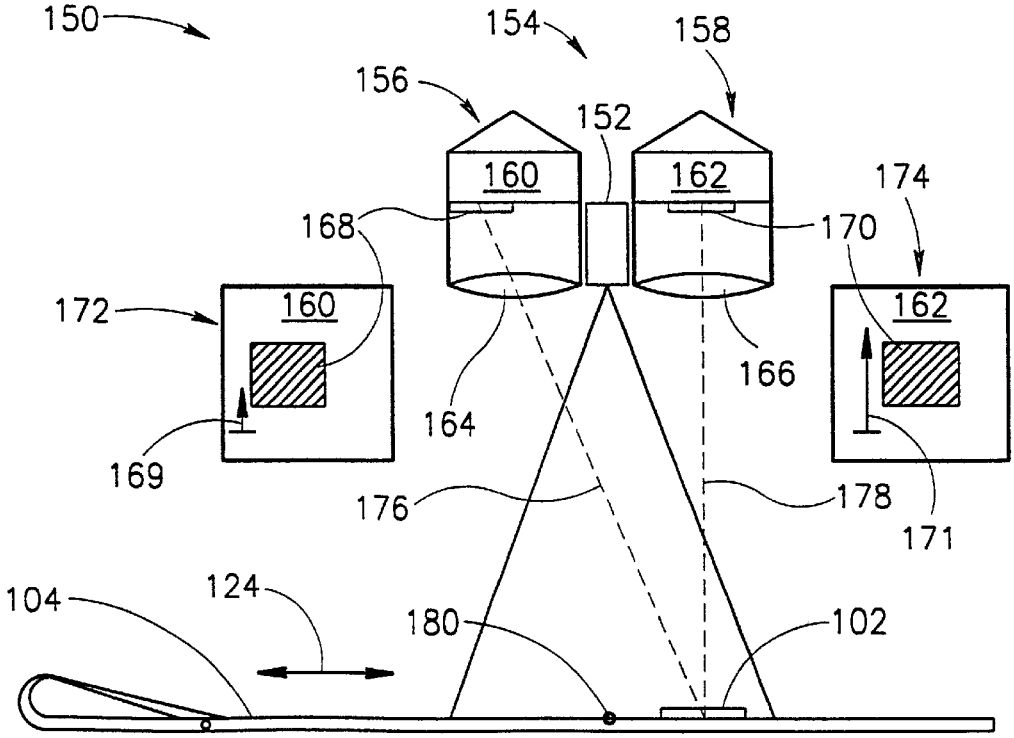
Figure 10C:
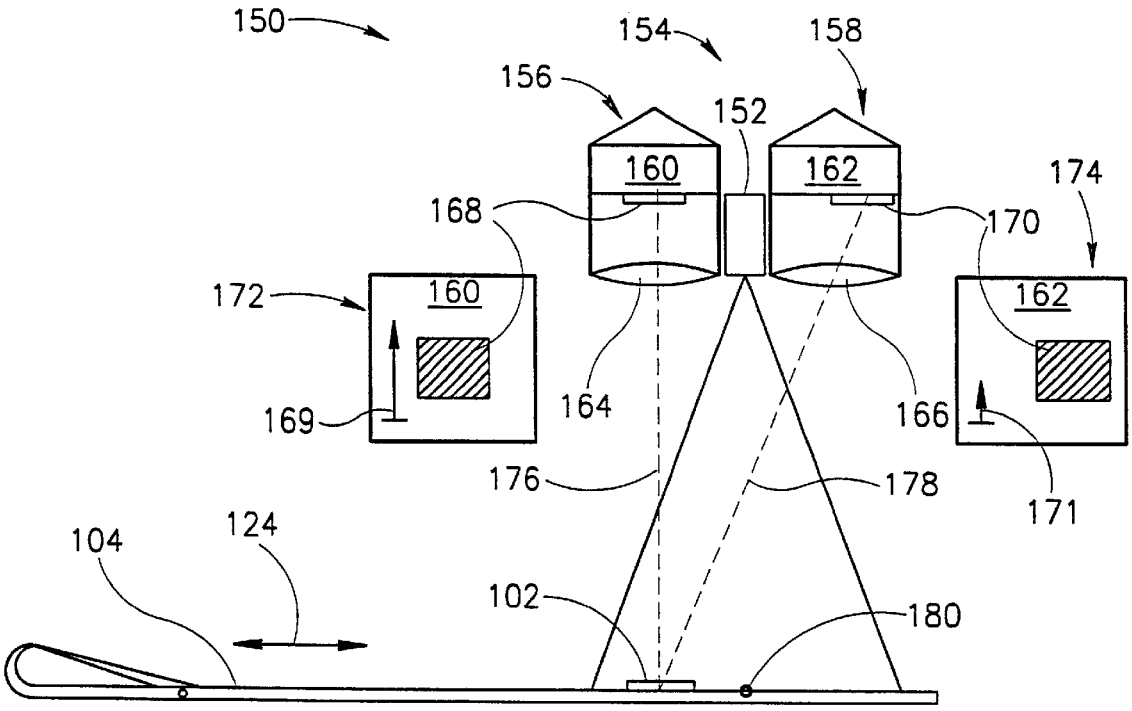

FIGS. 10A–10C schematically illustrate an OPM 150, in accordance with another preferred embodiment of the present invention, imaging fiducial 102 of latch needle 104. OPM 150 comprises a fiducial illuminator 152 and a fiducial imager 154 comprising two, preferably identical, detectors 156 and 158. Fiducial illuminator 152 illuminates fiducial 102 of latch needle 104. Fiducial 102 reflects some of the light incident on fiducial 102 towards each of detectors 156 and 158.

Detectors 156 and 158 have light sensitive surfaces 160 and 162 (shown greatly exaggerated in thickness for convenience and clarity of presentation) and lenses 164 and 166 respectively. Lens 160 focuses reflected light from fiducial 102 to provide an image 168 of fiducial 102 on light sensitive surface 160. Similarly, lens 166 provides an image 170 of fiducial 102 on light sensitive surface 162. Light sensitive surface 160 with image 168, and light sensitive surface 162 with image 170, are shown schematically, in ventral view, in views 172 and 174 respectively in each of FIGS. FIGS. 10A–10C. The intensities of images 168 and 170 are schematically represented in each of views 172 and 174 by the length of arrows 169 and 171 respectively. The relative sizes of arrows 169 and 171 are greatly exaggerated for clarity and ease of presentation in comparison to the actual relative intensities of images 168 and 170. Each of detectors 156 and 158 provides a signal to a controller (not shown) that is a function of the intensity of reflected light imaged on its light sensitive surface.

Detectors 156 and 158 are displaced from each other a small distance, "d", and both are located at a height, "r", directly above latch needle 104. OPM 150 is oriented with respect to latch needle 104 so that a line between the centers of lenses 164 and 166 is parallel to latch needle 104. Dashed lines 176 and 178 represent central rays of light reflected from fiducial 102 into detectors 156 and 158 respectively.

In FIG. 10A fiducial 102 is located at a point 180 that is equidistant from detectors 156 and 158. Both detectors receive substantially the same amounts of reflected light from fiducial 102. Arrows 169 and 171 in views 172 and 174 respectively are therefore shown the same size. The difference between the intensities of light reaching detectors 156 and 158 is zero.

In FIG. 10B fiducial 102 is displaced from point 180 to the right. As a result of the displacement, the distance from fiducial 102 to detector 158 decreases and the distance from fiducial 102 to detector 156 increases. This increases the amount of reflected light reaching detector 158 from fiducial 102 and decreases the amount of reflected light reaching detector 156 from fiducial 102. The size of arrow 171 in view 174 is therefore shown much larger than the size of arrow 169 in view 172. The difference between the intensities of light reaching detectors 156 and 158, defined as the amount of light reaching detector 156 minus the amount of light reaching detector 156, is negative.

In FIG. 10C fiducial 102 is displaced from point 180 to the left. This increases the amount of reflected light reaching detector 156 from fiducial 102 and decreases the amount of reflected light reaching detector 158 from fiducial 102. In this case, the size of arrow 171 in view 174 is therefore shown much smaller than the size of image 169 in view 172. The difference between the intensities of light reaching detectors 156 and 158, as defined above, is positive.

From considerations of geometry it can readily be shown that when r>>d, if the displacement of fiducial 102 from point 180 is represented by "Δx", the difference between the intensities of light reaching detectors 156 and 158 is proportional to $\Delta xd/r^4$. The difference between the signals sent by detectors 156 and 158 to the controller, which are functions of the intensities of reflected light registered by detectors 156 and 158 respectively, can therefore be used to determine Δx and the position of fiducial 102.

FIGS. 1A–11C schematically show an OPM 190, in accordance with yet another preferred embodiment of the present invention, imaging fiducial 102 of latch needle 104. OPM 190 comprises a fiducial illuminator 192 and a fiducial imager 194. Fiducial imager 194 comprises a single detector 196 and two lenses 198 and 200. Fiducial illuminator 192 illuminates fiducial 102 of latch needle 104. Fiducial 102 reflects some of the light incident on it from fiducial illuminator 192 towards each of lenses 198 and 200. A central ray of reflected light from fiducial 102 to lens 198 is represented by dashed line 202 and dashed line 204 represents a central ray from fiducial 102 to lens 200.

Detector 196 comprises a light sensitive surface 206 (shown greatly exaggerated in thickness for convenience and clarity of presentation) that is sensitive to light in two non-overlapping wavelength bands of light. Fiducial illuminator 192 illuminates fiducial 102 with preferably equal intensities of light from both wavelength bands. Each of lenses 198 and 200 transmits light in only one of the two different wavelength bands. Lens 198 focuses reflected light in one of the two wavelength bands to form an image 214 on light sensitive surface 206. Lens 200 focuses reflected light in the other of the two wavelength bands to form an image 216 on light sensitive surface 206. Detector 196 sends a first signal to a controller (not shown) that is a function of the amount of light in image 214 and a second signal to the controller that is a function of the amount of light in image 216.

Lenses 198 and 200 are displaced a short distance from each other and the line connecting the centers of lenses 198 and 200 is aligned parallel with and directly above latch needle 104. Assume that fiducial illuminator 192 is either located equidistant from lenses 198 and 200, or that any biases in the relative amounts of light reflected by fiducial 102 onto lenses 198 and 200 resulting from an asymmetric location of fiducial illuminator 192 with respect to lenses 198 and 200 are corrected for. Then, when fiducial 102 is equidistant from lenses 198 and 200, detector 196 registers equal intensities of light for both images 214 and 216 (i.e. surface 206 registers the same intensity of light in both of the wavelength bands to which it is sensitive). As fiducial 102 is displaced towards one or the other of lenses 198 and 200, the relative intensities of light registered for images 214 and 216 changes.

Figure 11A:
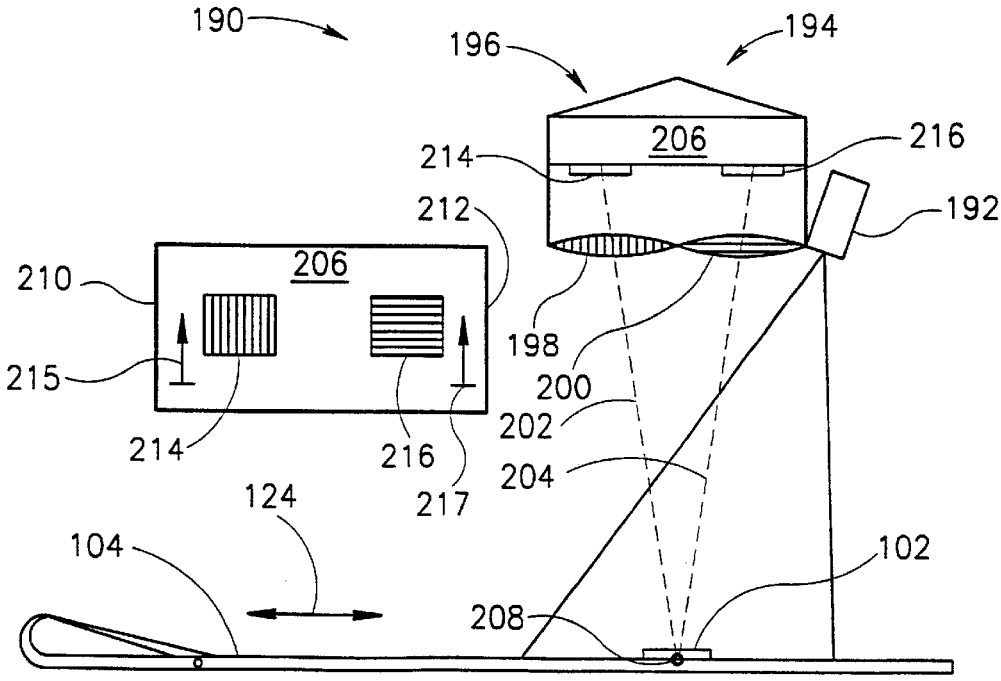
FIGS. 11A–11C schematically illustrate an OPM comprising a single fiducial imager, imaging a latch needle fiducial, in accordance with yet another preferred embodiment of the present invention.
Figure 11B:
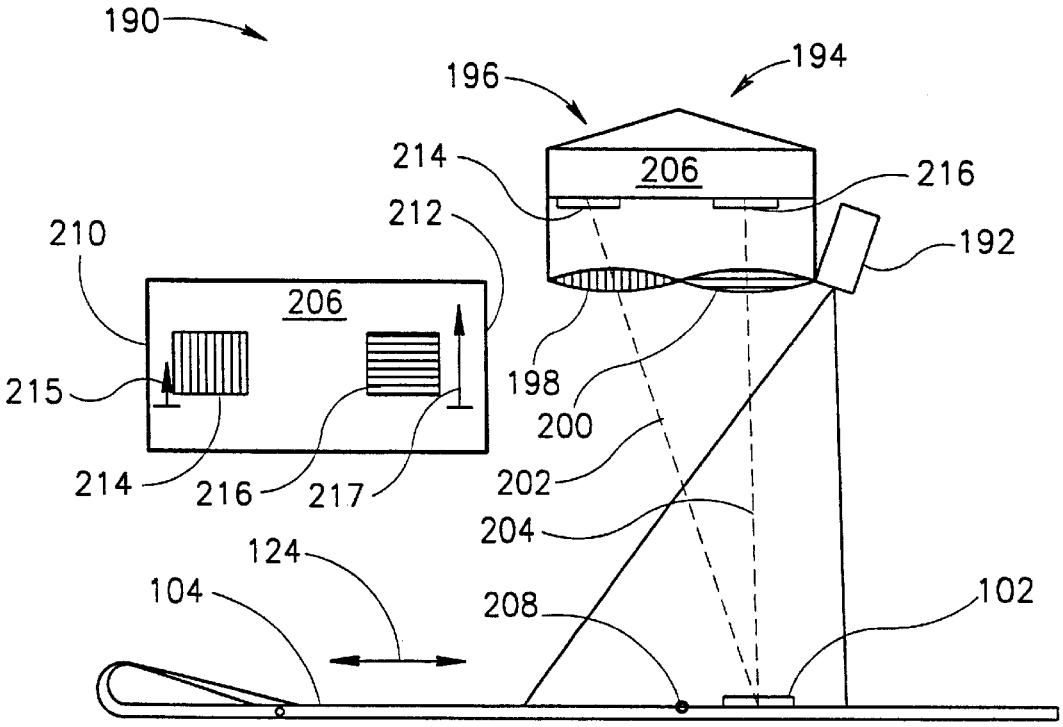
Figure 11C:
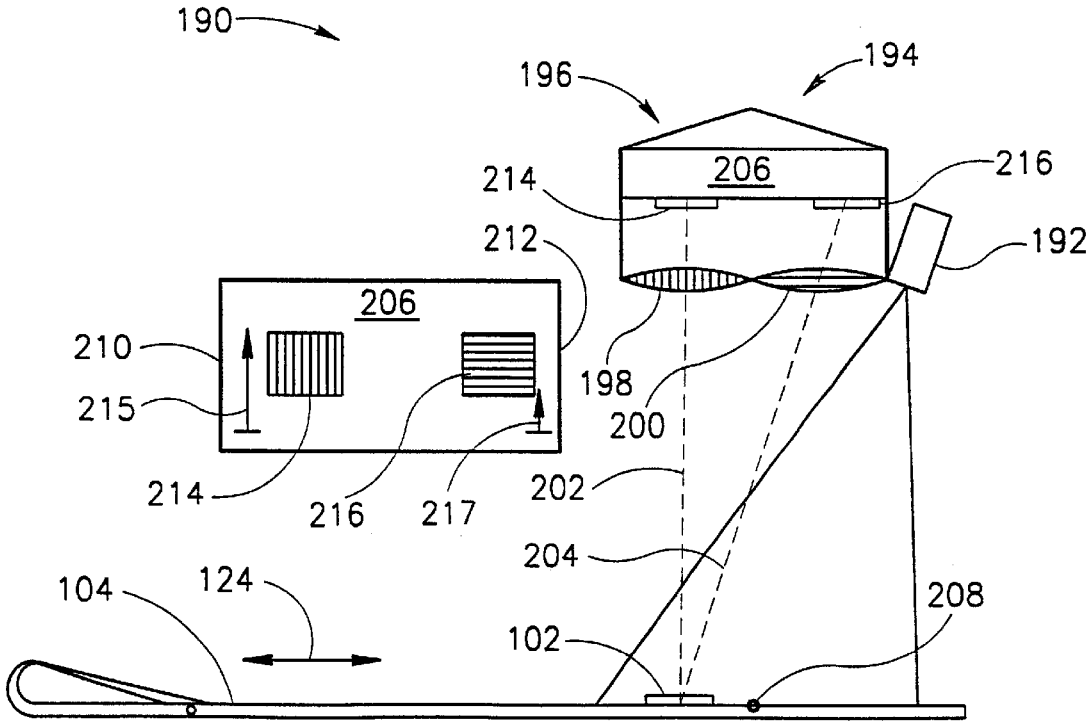

FIG. 11A shows fiducial light 102 located at a point 208 equidistant from lens 198 and 200. FIGS. 11B and 11C show fiducial 102 displaced right and left respectively of point 208. View 210 each of FIGS. 11A–11C is a ventral view of light sensitive surface 206. View 210 shows schematically images 214 and 216 of fiducial 102 that are formed on light sensitive surface 206 by lenses 198 and 200 respectively. The sizes of arrows 215 and 217 in view 210 represent schematically with greatly exaggerated scale the relative amounts of light in images 214 and 216 respectively for the different positions of fiducial 102 shown in FIGS. 11A–11C.

From considerations of geometry it can readily be shown, as in the case of OPM 150 shown in FIGS. 10A–10C, that for a displacement Δx of fiducial 102 from point 208, the difference between the intensities of light registered by detector 196 for images 214 and 216 is substantially proportional to Δx. The signals sent by detector 206 to the controller, which are functions of the intensities of light registered by detector 206 for images 214 and 216 can therefore be used to determine Δx and thereby the position of fiducial 102.

Figure 12A:
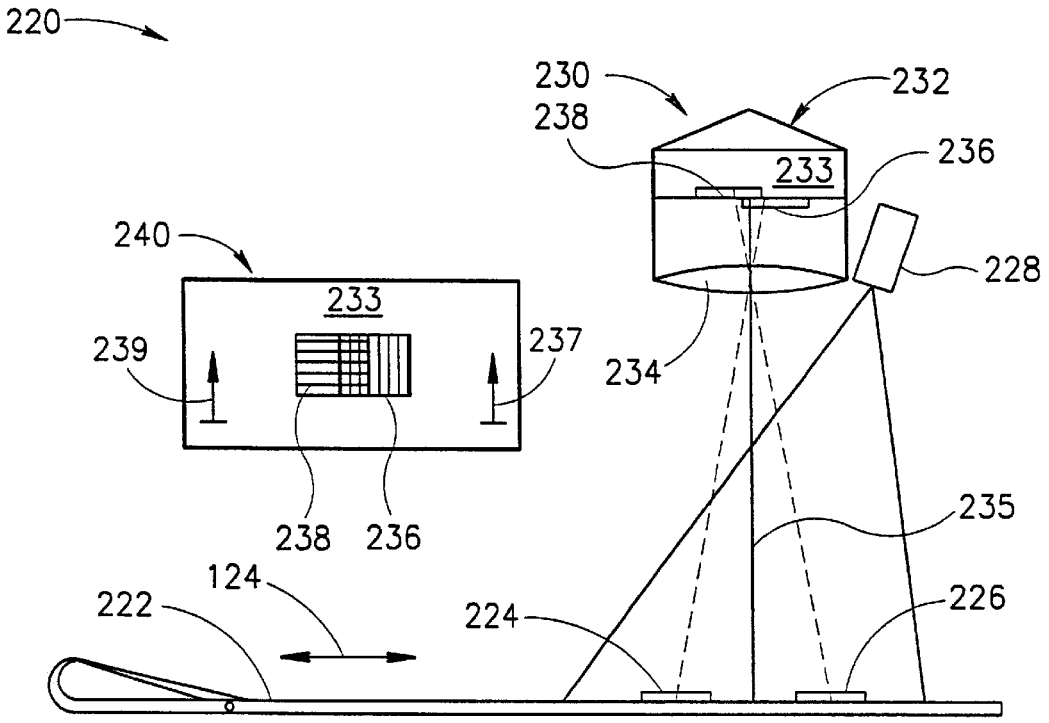
FIGS. 12A–12C schematically illustrate an OPM comprising a single fiducial imager, imaging a latch needle fiducial, in accordance with still another preferred embodiment of the present invention.
Figure 12B:
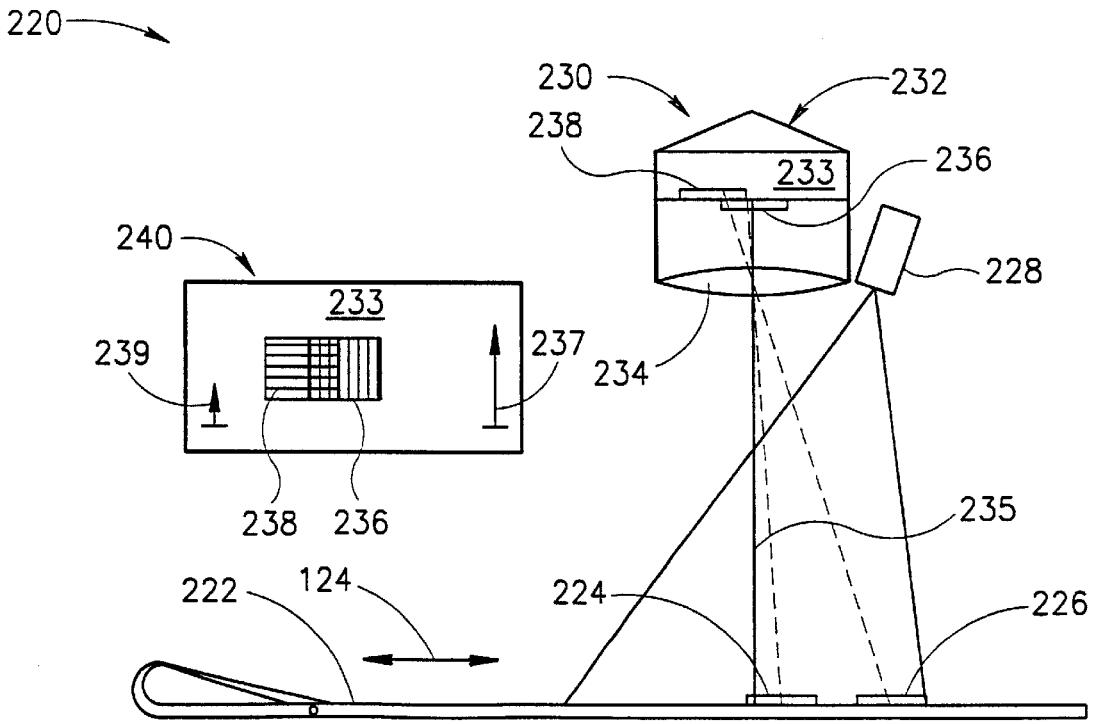
Figure 12C:
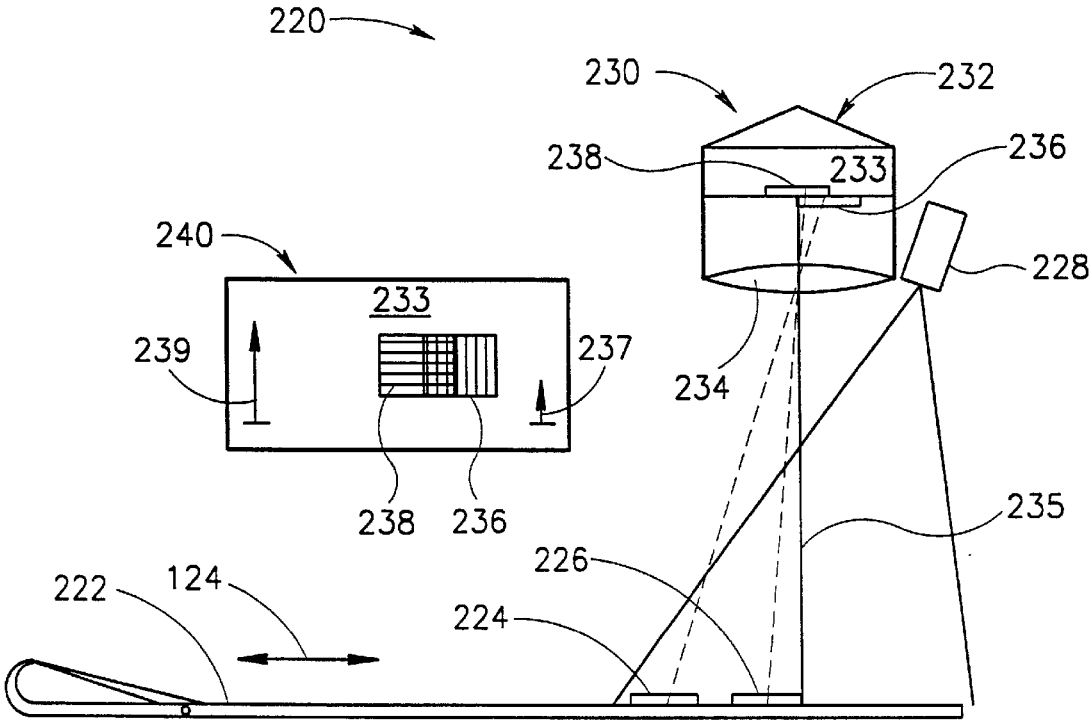

FIGS. 12A–12C schematically show an OPM 220, in accordance with yet another preferred embodiment of the present invention that is used to measure the position of a latch needle provided with two fiducials. In FIGS. 12A–12C, OPM, 220 is shown imaging a latch needle 222 provided with a fiducial 224 and a fiducial 226.

OPM 220 comprises a fiducial illuminator 228 and a fiducial imager 230. Fiducial imager 230 comprises a single detector 232 and a single lens 234 having a lens axis 235. Detector 232 comprises a light sensitive surface 233 (shown greatly exaggerated in thickness for convenience and clarity of presentation) that is sensitive to light in two non-overlapping wavelength bands of light. Fiducial illuminator 228 illuminates fiducials 224 and 226 preferably with light having equal intensities in both wavelength bands. Fiducial 224 reflects light in only one of the two wavelength bands and fiducial 226 reflects light in only the other of the two wavelength bands. Lens 234 images the reflected light from fiducials 224 and 226 to form an image 236 of fiducial 224 on surface 233 in one of the two wavelength bands and an image 238 of fiducial 226 on surface 233 in the other of the two wavelength bands. Detector 232 sends a signal to a controller (not shown) for each of images 236 and 238 that is a function of the intensity of light in the image.

Images 236 and 238 have the same intensities, in their respective wavelength bands, only when fiducials 224 and 226 are substantially equidistant from axis 235 of lens 234. For different positions of latch needle 222, one or the other of fiducials 224 and 226 is closer to axis 235. The image of the fiducial closer to axis 235 is more intense than the image of the fiducial farther from axis 235. Differences in intensities of images 236 and 238 registered by detector 232 are used to determine the position of fiducials 224 and 226 and thereby of latch needle 222.

FIG. 12A shows latch needle 222 in a position for which fiducials 224 and 226 are equidistant from axis 235. FIG. 12B shows latch needle 222 in a position in which fiducials 224 and 226 are displaced to the right of their respective positions shown in FIG. 12A, and FIG. 12C shows latch needle 222 in a position in which fiducials 224 and 226 are displaced to the left of their respective positions shown in FIG. 12A. In each of FIGS. 12A–12C, view 240 is a ventral view of light sensitive surface 234 schematically showing images 236 and 238. The sizes of arrows 237 and 239 shown in ventral view 240 represent schematically and in greatly exaggerated scale, the relative intensities of images 236 and 238 for the position of latch needle 222 shown in the FIG.

Figure 13A:
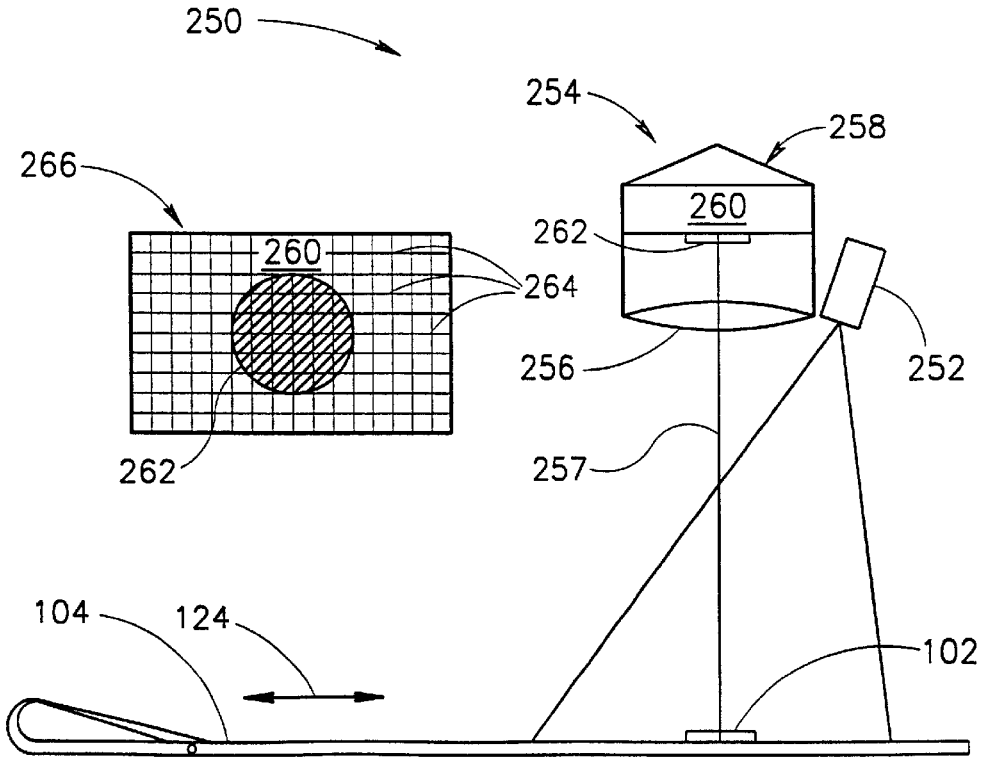
FIGS. 13A–13C schematically illustrate an OPM comprising a single fiducial imager, imaging a latch needle fiducial, in accordance with another alternative preferred embodiment of the present invention.
Figure 13B:
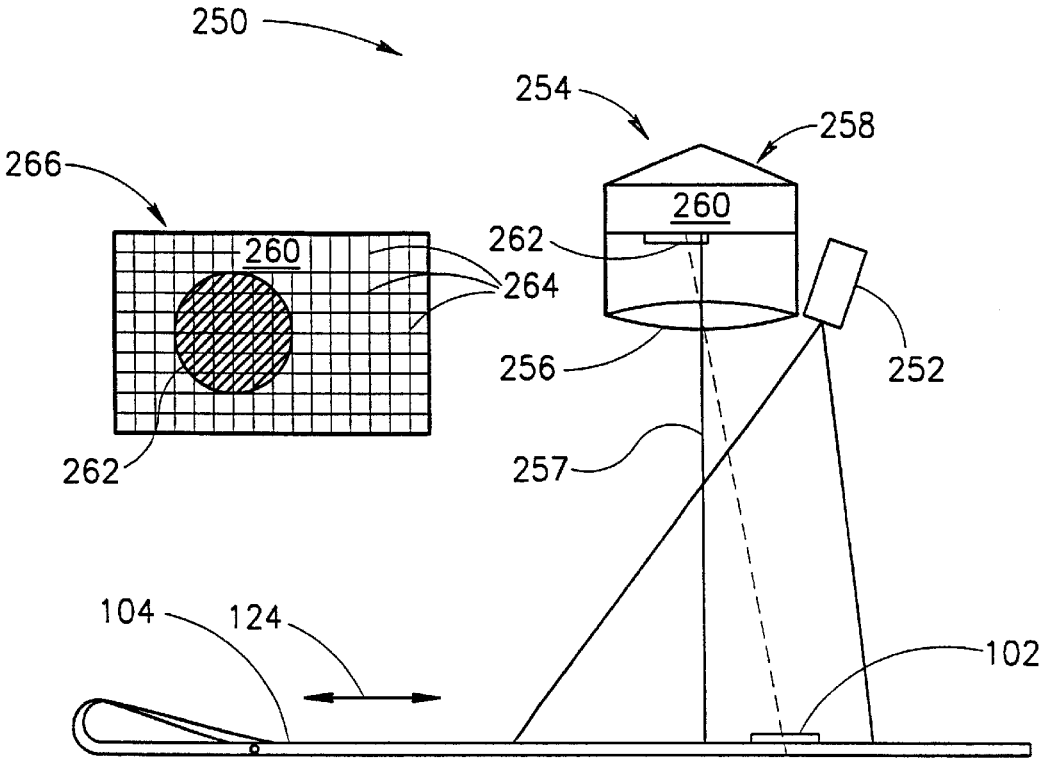
Figure 13C:
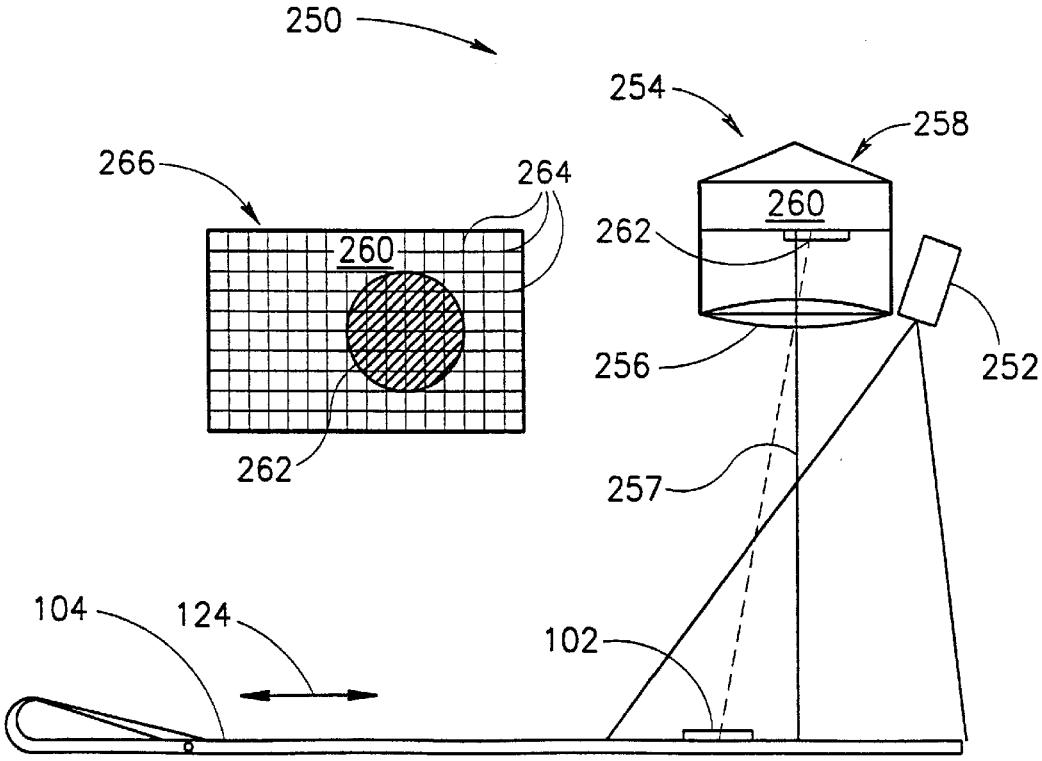

FIGS. 13A–13C show an OPM 250 imaging fiducial 102, in accordance with yet another preferred embodiment of the present invention. OPM 250 comprises a fiducial illuminator 252 and a fiducial imager 254. Fiducial imager 254 comprises a lens 256 having an optic axis 257 and a detector 258, such as a CCD, having a pixelated light sensitive surface 260 (shown greatly exaggerated in thickness for convenience and clarity of presentation). Lens 256 focuses reflected light from fiducial 102 to form an image 262 of fiducial 102 on pixelated surface 260.

In OPM 250 the position of fiducial 102 is determined using the rules of basic optics from the location of image 262 on pixelated surface 260. FIGS. 13A–13C show schematically the spatial relationship between the position of fiducial 102 and image 262 of fiducial 102 on pixelated surface 260. Image 262 and pixels 264 of pixelated surface 260 are shown schematically in a ventral view 266 of pixelated surface 260 in each of FIGS. 13A–13C. In FIG. 13A fiducial 102 is located on optic axis 257 and image 262 is located at the center of pixelated surface 260 shown in view 264 (assuming lens 256 and detector 258 are aligned). In FIGS. 13B and 13C, fiducial 102 is displaced to the right and to the left of optic axis 257 respectively. Image 262 on pixelated surface 260 moves accordingly to the left and the right of the point at which image 262 is located when fiducial 102 is on optic axis 257.

Image 262 is preferably focused by lens 256 so that it covers a plurality of pixels on light sensitive surface 260. Using methods well known in the art, an optical center of gravity of image 262 can be defined and located on pixelated surface 260 to sub-pixel accuracy. Using the location of the optical center of gravity of image 262, the position of fiducial 102 and latch needle 104 are determined by OPM 250 with an accuracy sufficient for controlling latch needle actuators in a DDM.

FIGS. 13A–13C show OPM 250 being used to determine the position of a single latch needle 104, by imaging a fiducial 102 located on the latch needle 104. However, a single OPM of the form of OPM 250, in accordance with a preferred embodiment of the present invention, can be used to determine the position of a plurality of latch needles 104. This is accomplished by providing the detector 258 of the OPM with a field of view that includes the fiducial 102 of each of the plurality of latch needles 104. Each fiducial 102 of a latch needle of the plurality of latch needles is imaged on a different rectangular region of pixelated surface 260 of the OPM. As the latch needle 104 on which the fiducial 102 is located moves back and forth in its operational range of motion, (indicated schematically by double headed arrow 124) the image of its fiducial 102 moves back and forth along the length of the rectangular region of pixelated surface 260 on which it is imaged.

For example, in one preferred embodiment of the present invention, detector 258 is provided with a field of view that focuses an area of a needle bed having a dimension perpendicular to latch needles 104 that is on the order of 5 cm. The dimension of the field of view in the direction parallel to latch needles 104 is on the order of the operational range of motion of latch needles 104. If the spacing between latch needles 104 in the needle bed is 2 mm the fiducials 102 of 25 latch needles 104 will be in the field of view of the OPM. Assuming that pixelated surface 260 of detector 258 comprises a square matrix, 5 mm on a side, comprising 512 rows and 512 columns of pixels fiducials 102 of the 25 latch needles 104 in the field of view of detector 258 are imaged on parallel rectangular regions of pixelated surface 260 that are approximately 20 pixels wide and 512 pixels long. If the operational range of motion of a latch needle 104 is on the order of 5 cm, and the optical center of gravity of the image of a fiducial is located with a resolution of 0.4 pixels, the position of fiducial 102 and its latch needle 104 are located with an accuracy of about 40 micrometers.

Variations of the above-described preferred embodiments will occur to persons of the art. The above detailed descriptions are provided by way of example and are not meant to limit the scope of the invention, which is limited only by the following claims.

What is claimed is:

1. An actuator system for activating a latch needle, which latch needle has a shaft, comprising:

a flat planar extension of said shaft having first and second parallel planar surfaces;

at least one piezoelectric micromotor having a first surface region for transmitting motion to a moveable element, which first surface region is resiliently pressed to said first surface and at least one additional piezoelectric motor having a second surface region for transmitting motion to a moveable element which second surface region is resiliently pressed to said second surface; and wherein vibratory motions of said first and second surface regions apply forces to said flat extension that cause motion in said latch needle.

2. An actuator system for activating a latch needle, which latch needle has a thin flat shaft comprising:

a flat planar extension of said shaft having first and second planar surfaces;

a piezoelectric micromotor having a surface region for transmitting motion to a moveable element;

a transmission bracket for holding said piezoelectric micromotor, said transmission bracket comprising a bearing surface and a means for resiliently urging said surface region of said piezoelectric micromotor towards said bearing surface; and wherein said flat extension is inserted between said surface region of said piezoelectric micromotor and said bearing or said non-stick surface and wherein vibratory motion of said surface region applies force to said flat extension causing motion in said latch needle.

3. An actuator system according to claim 2 wherein said bearing surface is the surface of a rotatable roller or ball.

4. An actuator system according to claim 2 wherein said bearing surface is a surface having a low friction coating.

5. An actuator system for activating a latch needle, according to claim 1 wherein said surface region for transmitting motion to a moveable element comprises a wear resistant nub that makes contact with a surface of said moveable element towards which said surface region for transmitting motion is resiliently pressed in order to transmit motion to said moveable element.

6. An actuator system for activating a latch needle, according to claim 1 wherein points on surfaces of said flat extension at which said surface regions of said piezoelectric micromotors make contact are clad in wear resistant material.

7. An actuator system for activating a latch needle, according to claim 2 wherein said surface region for transmitting motion to a moveable element comprises a wear resistant nub that makes contact with a surface of said moveable element towards which said surface region for transmitting motion is resiliently pressed in order to transmit motion to said moveable element.

8. An actuator system for activating a latch needle, according to claim 2 wherein points on surfaces of said flat extension at which said surface regions of said piezoelectric micromotors make contact are clad in wear resistant material.

* * * * *